US008979411B2

(12) United States Patent
Ballot

(10) Patent No.: US 8,979,411 B2
(45) Date of Patent: Mar. 17, 2015

(54) LIQUID APPLICATOR

(75) Inventor: Stephan M. Ballot, Barrington Hills, IL (US)

(73) Assignee: Flocon Inc., Cary, IL (US)

( * ) Notice: Subject to any disclaimer, the term of this patent is extended or adjusted under 35 U.S.C. 154(b) by 1392 days.

(21) Appl. No.: 12/288,267

(22) Filed: Oct. 17, 2008

(65) Prior Publication Data

US 2009/0103968 A1 Apr. 23, 2009

Related U.S. Application Data

(60) Provisional application No. 60/999,597, filed on Oct. 19, 2007, provisional application No. 61/126,777, filed on May 7, 2008.

(51) Int. Cl.

| | |
|---|---|
| ***B43K 5/00*** | (2006.01) |
| ***B43K 5/18*** | (2006.01) |
| ***B43K 7/10*** | (2006.01) |
| ***B43K 8/04*** | (2006.01) |

(52) U.S. Cl.

CPC ..... *B43K 5/1845* (2013.01); *B43K 7/10* (2013.01); *B43K 8/04* (2013.01)

USPC ..... 401/206; 401/6

(58) Field of Classification Search

CPC .. B43K 23/008; B43K 23/004; B43K 5/1845; B65D 47/42

USPC ..... 401/6, 206

See application file for complete search history.

(56) References Cited

U.S. PATENT DOCUMENTS

| | | | | |
|---|---|---|---|---|
| 1,857,467 | A | | 5/1932 | Marsh |
| 2,024,413 | A | | 12/1935 | Witt |
| 2,104,638 | A | | 1/1938 | Cuthbert |
| 2,210,662 | A | | 8/1940 | Garvey |
| 2,330,053 | A | | 9/1943 | Herb |
| 2,611,916 | A | | 9/1952 | Prokop et al. |
| 2,716,250 | A | | 8/1955 | Deakers |
| 3,038,193 | A | * | 6/1962 | Harris et al. ..... 401/206 |
| 3,201,012 | A | * | 8/1965 | De Malglaive ..... 222/501 |
| 3,468,611 | A | | 9/1969 | Ward |
| 3,484,027 | A | | 12/1969 | Micallef |
| 4,569,612 | A | | 2/1986 | Schwartzman et al. |
| 4,685,820 | A | | 8/1987 | Kremer et al. |
| 4,792,252 | A | | 12/1988 | Kremer et al. |
| 4,812,071 | A | | 3/1989 | Batra et al. |
| 4,848,947 | A | | 7/1989 | Kremer et al. |
| 4,913,175 | A | | 4/1990 | Yokosuka et al. |
| 4,976,564 | A | | 12/1990 | Fukuoka et al. |

(Continued)

FOREIGN PATENT DOCUMENTS

| | | |
|---|---|---|
| FR | 995150 | 6/1949 |
| NL | 1016153 | 3/2002 |

*Primary Examiner* — Christopher Kim

(74) *Attorney, Agent, or Firm* — Frijouf, Rust & Pyle P.A.

(57) ABSTRACT

A liquid applicator is disclosed comprising a liquid container and a liquid dispensing mechanism having a valve element enabling an axial displacement of an applicator tip to move the valve element into the open position for enabling the applicator tip to apply the liquid to a surface. The improvement comprises an applicator closure having a closure coupling for coupling the applicator closure to a peripheral rim of a container. An optional shield may be secured to the applicator closure for providing protection between the applicator tip and an operator grasping the liquid container.

18 Claims, 17 Drawing Sheets

(56) References Cited

U.S. PATENT DOCUMENTS

| | | | | |
|---|---|---|---|---|
| 4,984,923 | A | 1/1991 | Ota | |
| 4,993,859 | A | 2/1991 | Assad et al. | |
| 5,899,624 | A | 5/1999 | Thompson | |
| 6,010,263 | A * | 1/2000 | White et al. | 401/15 |
| 6,513,681 | B2 | 2/2003 | Gross | |
| 6,634,821 | B2 | 10/2003 | Gueret | |
| 6,641,320 | B1 | 11/2003 | Ballot et al. | |
| 6,773,193 | B2 | 8/2004 | Delage | |
| 6,817,801 | B1 | 11/2004 | Colburn et al. | |
| 6,817,802 | B2 | 11/2004 | Nishitani et al. | |
| 6,883,995 | B1 | 4/2005 | Gueret | |
| 6,935,536 | B2 | 8/2005 | Tardif | |
| 6,945,722 | B2 | 9/2005 | Colburn et al. | |
| 7,101,105 | B2 | 9/2006 | Reggiani | |
| 7,114,871 | B2 | 10/2006 | Thiebaut | |
| 7,563,046 | B2 | 7/2009 | Patel | |
| 2002/0021933 | A1 | 2/2002 | Knieriemen | |
| 2005/0141951 | A1 | 6/2005 | Gueret | |
| 2006/0083577 | A1 | 4/2006 | Gueret | |
| 2009/0103968 | A1 | 4/2009 | Ballot | |

* cited by examiner

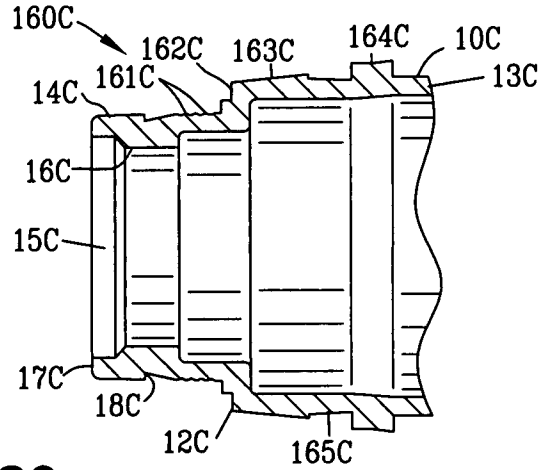
FIG. 29
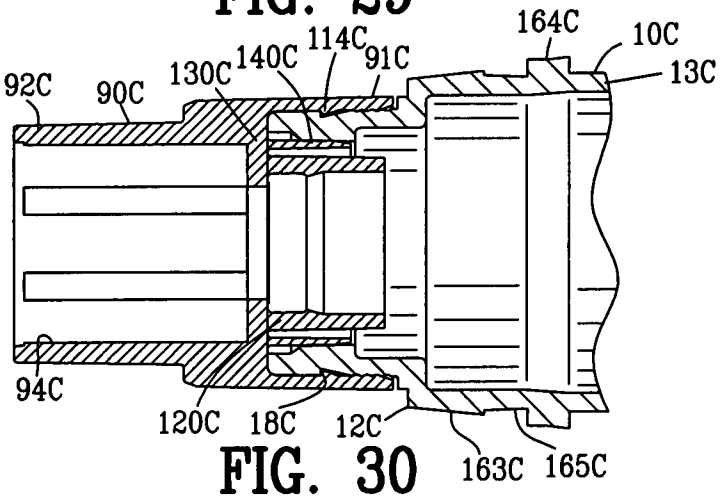
FIG. 30
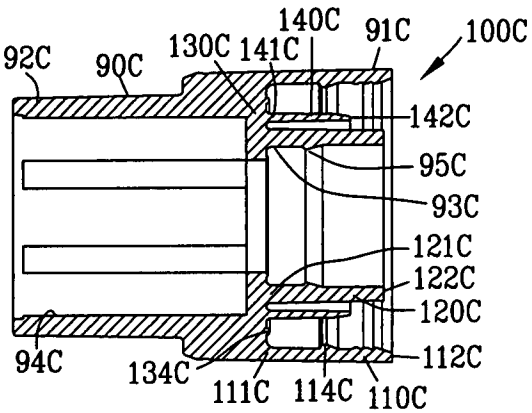

LIQUID APPLICATOR

CROSS-REFERENCE TO RELATED APPLICATIONS

This application claims benefit of U.S. Patent Provisional application No. 60/999,597 filed Oct. 19, 2007 and U.S. Patent Provisional application No. 61/126,777 filed May 7, 2008. All subject matter set forth in provisional application No. 60/999,597 and provisional application No. 61/126,777 is hereby incorporated by reference into the present application as if fully set forth herein.

BACKGROUND OF THE INVENTION

1. Field Of The Invention

This invention relates to the dispensing of liquids and more particularly, this invention relates to an improved liquid applicator for marking, writing or dispensing a liquid on a surface.

2. Background Of The Invention

Various types of liquid applicator devices have been devised for dispensing a liquid. Some of these liquid applicator devices were used for dispensing an applicator liquid for writing with ink, dye or paint. Among such devices were fountain pens, ball point pens, felt tip pens as well as other types of liquid applicator devices and the like.

These liquid applicator devices of the prior art have received wide acceptance due in great measure to the convenience of the device. Furthermore, these liquid applicator devices of the prior art had the ability to retain a large quantity of applicator liquid and the ability to supply additional applicator liquid from a liquid container to an applicator tip at the discretion of the user. In addition, the liquid applicator devices were not limited to the dispensing of only writing liquid such as paints, dyes and the like but are capable of dispensing a large variety of applicator liquids including chemicals, perfumes, lubricants, cleaners, paints, coatings and the like.

Continuing efforts have been made in the past to improve the design of the liquid applicator devices. The improved design of the liquid applicator devices have concentrated on the liquid dispensing mechanism and for improving the communication of the liquid from the liquid container to the applicator tip for dispensing the applicator liquid onto a surface. In one example of a liquid applicator device, an applicator liquid flows into a fiber applicator tip only when the liquid applicator device is held upside down and the fiber applicator tip is depressed by a surface to be coated by the applicator liquid.

U.S. Pat. No. 1,857,467 to Marsh discloses a fountain marker comprising a main reservoir adapted to contain fluid with an end wall for the reservoir having an opening. An auxiliary reservoir is arranged to receive fluid through the opening with a valve opening and closing the discharge outlet. A stem connected to the valve extends through the opening. The fluid is admitted from the main reservoir to the auxiliary reservoir when the valve is closed and is prevented from flowing from the main reservoir to the auxiliary reservoir when the valve is in an open position. A spring holds the valve closed with an applicator tip attached to the valve.

U.S. Pat. No. 2,024,413 to Witt discloses a fountain brush comprising an elongated hollow handle forming a liquid reservoir. A cap is secured to the forward end of the handle having an elongated frusto-conical valve seat and a closure cap on the opposite end of the handle. An elongated conical valve is received in the valve seat. An inwardly projecting stem is formed on the rear end of the valve. The forward end of the valve carries an outwardly projecting shank. A cross-head on the stem having an end is slidably engaged with the inner face of the hollow handle. A contractile coil spring is disposed about the stem having one end anchored to the stem and the other end being anchored in place between the forward cap and handle. A brush-head on the shank and a conical deflector formed on the brush-head are arranged in facing relation to the valve for receiving liquid.

U.S. Pat. No. 2,210,662 to Garvey discloses a writing instrument comprising a reservoir for the writing fluid and a valve tiltable in different directions to control the discharge of fluid from the reservoir. A tiltable tip holder is united with and extends from the tiltable valve with the tiltable tip holder having an internal screw thread. A writing tip is made of a yieldable absorbent material and is screwed into the internal thread to project from the lower end of the tip holder. The writing tip is adjustable longitudinally on the screw thread in response to rotary movements of the tip independently of the tip holder. A means limits the rotary movements of the tip holder and includes a tiltable abutment carried by and tiltable with the united valve and tip holder and a fixed abutment co-operating with the tiltable abutment.

U.S. Pat. No. 2,330,053 to Herb discloses a fountain applicator comprising a fluid containing reservoir and a marking nib and means operable by pressure on the nib in excess of that required for marking therewith for forcing fluid from the reservoir to the nib.

U.S. Pat. No. 3,468,611 to Ward discloses a liquid applicator having a tubular member of flexible side wall construction. A porous applicator nib and valve means control the flow of liquid from the tubular member to the applicator nib.

U.S. Pat. No. 3,484,027 to Micallef discloses a valve closure for dispensing liquids from a container comprising a cap member attached to one end of the container having a centrally located boss member extending towards the interior of the container. An aperture in the boss member and a flange member is spaced from the boss member and adapted to engage the inside of the mouth of the container in sealing relationship. A valve member including a valve stem is mounted for rotation in the boss member. The valve stem has communicating radial and axial openings with an opening in the boss member being adapted to communicate with the radial opening thereby permitting selective opening and closing of the valve closure. A radially resilient extension extends from one end of the valve stem. The extension has portions which are radially compressible to permit assembly of the valve stem member and the boss member. The radially extending portions are adapted to cooperate with the boss member to prevent disassembly of the valve and the boss member, wherein the resilient extension has a semi-circular shape.

U.S. Pat. No. 4,685,820 to Kremer et al. discloses an improved applicator device for applying an applicator material such as a liquid or a flowable solid to a surface. The device comprises a material container and a surface applicator for applying the applicator material to the surface. A valve is interposed between the material container and the surface applicator to permit the flow of applicator material to the surface applicator when the valve is in an open position and to inhibit the flow of applicator material to the surface applicator when the valve is in a closed position. The valve includes a valve closure having an internal closure cavity with a first end being connected to the material container and with a second end defining a surface applicator opening therein. The valve element has a distal end portion that extends through the applicator opening of the valve closure when the valve element is biased into the closed position. The surface applicator comprises the distal end portion of the valve element cooperating with the applicator opening when the distal end portion of the valve element is pressed against the surface thereby forming an annular opening for the flow of the applicator material to apply and disperse the applicator material on the surface. U.S. Pat. No. 4,685,820 to Kremer et al. provided a significant step forward in the art of liquid applicator devices.

U.S. Pat. No. 4,792,252 to Kremer et al. discloses a liquid applicator device for applying a liquid such as a paint, a perfume, a chemical, a coating or the like to a surface by writing, marking or painting. The liquid applicator device includes a container for the liquid and an applicator dispensing mechanism. The applicator dispensing mechanism includes an inner subassembly having a valve and an outer subassembly having the surface applicator. The valve regulates the flow of the liquid from the container to the surface applicator. The valve of the applicator device may be opened to allow the liquid to flow from the container to the surface applicator upon depression of the surface applicator or upon depression of a valve actuator. The liquid applicator device incorporates an improved sealing member for sealing with the sides of the surface applicator for reducing the flow of the applicator liquid along the side of the surface applicator. The surface applicator may be in the form of a fiber tip, a brush or similar applicator. The applicator dispensing mechanism may be fabricated independent of the attachment to the container. The valve seal has a flexibly mounted tubular extension that holds the inner end of the surface applicator to maintain the liquid seal during lateral movement of the outer end of the surface applicator.

U.S. Pat. No. 4,976,564 to Fukuoka et al. discloses an implement for applying a liquid comprising a container having an opening at a front end and a front tube attached to the container forward end. A hollow accommodating member has a chamber in an interior and formed with a rearward communication hole and a forward communication hole for holding the chamber in communication with the interior of the container and the interior of the front tube respectively. A liquid feed member is accommodated in the chamber and is movable axially thereof. A biased end valve is disposed inside the front tube to provide a liquid retaining portion inside the front tube around the end valve for closing the forward end opening of the front tube. An applicator having a capillary action extends through the forward end opening of the front tube and is secured to the front end of the end valve.

U.S. Pat. No. 4,984,923 to Ota discloses an operating member inserted in the middle cylinder to be movable backward and forward in the axial direction. A valve mechanism is provided in the front portion of the middle cylinder to supply the pinpoint with the applied liquid stored in the rear portion of the middle cylinder. The valve mechanism includes a valve seat having a valve hole with a valve spindle being provided with a valve element for opening and closing the valve hole and a stretchable member for moving the valve spindle backward and forward. The stretchable member is elongated and shortened in the axial direction of the middle cylinder as the bent portions are bent less and more, respectively. The operating element at the rear end of the middle cylinder is operated to move the operating member forward to push the bent portions of the bent arms to elongate the stretchable member. The valve spindle is moved backward to open the valve hole to supply the applied liquid to the pinpoint.

U.S. Pat. No. 4,993,859 to Assad et al. discloses a liquid applicator including a valve body for insertion into the neck of a liquid container and defining a duct in the valve body. A resilient web is formed integrally with the valve body and extends transversely across the duct. A valve seat is located on one end of the valve body. A valve member is secured to the resilient web and has a valve biased into engagement with the valve seat at the end of the valve body. A coating member is mounted on the opposite end of the valve body. A valve stem on the valve member is located proximate the coating member for being deflected when the coating member is compressed onto an external surface to thereby unseat the valve and permit liquid to flow through the duct onto the coating member.

U.S. Pat. No. 4,913,175 to Yokosuka et al. discloses a liquid-applying tip assembly in which the liquid-applying member is pushed to operate the valve to allow the liquid to flow to the liquid-applying member. The liquid-applying member is a plastic member that comprises a plurality of ribs extending radially and axially from an axial core in such a manner as to form a plurality of axial liquid passageways therebetween. A barrier is provided between the valve and the cylinder of the tip assembly, the barrier having a hole whose diameter is slightly larger than the outside diameter of the liquid-applying member to control the flow of liquid.

U.S. Pat. No. 6,513,681 to Gross et al. discloses a spray dispensing closure including a spray plug and a cap cooperating therewith to selectively occlude passages in the spray plug. A spray plug includes a set of inner passages for conveying product from a dip tube through the spray plug and a set of outer passages for conveying air from a head space in the container. The inner passages communicate with an inner flow space and the outer passages communicate with an outer flow space. A cap cooperates with the spray plug to define an outer chamber and an inner chamber that are isolated from one another when the cap is in the closed position, thereby preventing the mixing of air and product. As the cap is moved to the open position, the cap chambers are permitted to communicate with one another and, as the container is squeezed, a product/air mixture is formed in the closure. A central spray plug post has an upper portion that forms at least one restrictive passage with an inner wall of the cap when the cap is in the open position. As the air/product mixture flows through the restrictive passages, a spray mist is formed and dispensed through at least one dispensing orifice formed in the cap and communicating with the restrictive passages. In an alternative embodiment, only a single set of inner passages are provided on the spray plug and communicate with the head space in the container. A series of dip tube exit passages extend from a proximal end of the dip tube. A plurality of dip tube end engaging ribs extend from the spray plug. When the container is squeezed and the cap is open, product is conveyed from the dip tube and into the inner passages to be mixed with air from the head space.

U.S. Pat. No. 6,634,821 to Gueret discloses a device and system for applying a product, for example, a cosmetic product. The device includes a first compartment containing the product, and a second compartment in flow communication with the first compartment via at least one supply orifice, with the second compartment having an opening that may be removably closed by a closure element. The second compartment may form a housing for an applicator that is insoluble with respect to the product. The applicator may rest against an elastically compressible porous member that may be in flow communication with the supply orifice.

U.S. Pat. No. 6,773,193 to Delage discloses a device for packaging and applying a substance, in particular a cosmetic or a care product, the device comprising a receptacle for containing the substance. The receptacle is provided at the top with an applicator that is permeable to the substance and that has an inside face fed with the substance coming from the receptacle. In the vicinity of the bottom face of the applicator, the device comprises an element that forms an intermediate reservoir that is in permanent communication with the receptacle and that is suitable for retaining a certain quantity of the substance when the device is turned upside-down from a head-up position and is then returned to the head-up position. The intermediate reservoir-forming element are arranged to enable the substance retained in this way to feed the applicator, at least in certain conditions of use of the device.

U.S. Pat. No. 6,817,801 to Colburn et al. discloses an applicator device for applying treatment fluid to various interior surfaces such as those found in an automobile, which is constructed with an applicator head including a housing having a bottom distribution plate and an applicator pad affixed thereto, and which is configured to complementally and releasably receive an associated fluid container.

U.S. Pat. No. 6,817,802 to Nishitani et al. discloses a writing instrument adapted, responsive to a pressure axially applied to a pen core, to supply ink in an ink chamber to the pen core. The writing instrument includes a valve seat disposed between the ink chamber and the pen core. A valve body is operable to be selectively moved between a closed position where the valve body is in contact with the valve seat to isolate the pen core from the ink chamber and an open position where the valve body is spaced apart from the valve seat to communicate the pen core with the ink chamber. A pressing spring biases the valve body toward the front end of a pen shaft, and a support member for supporting the valve body and the pressing spring to allow the valve body to be moved in the axial direction. The support member includes a communication channel for communicating the inner space thereof with the ink chamber. The valve body has a channel control portion for allowing the ink flow through the communication channel to be more restricted when the valve body is in the closed position that when it is in the open position. The writing instrument can reduce the deposit of ink pigments around the valve body to prevent occurrence of defect in the operation of the valve body.

U.S. Pat. No. 6,945,722 to Colburn et al. discloses a tire applicator for applying treatment fluid to sidewall of a vehicle tire, which is constructed with an applicator head including a dispenser housing having a bottom distribution plate and an applicator pad affixed thereto, and which may be configured to complementally and releasably receive an associated container.

U.S. Pat. No. 7,101,105 to Reggiani discloses a container-applicator for fluid products for cosmetic and pharmaceutical use. An applicator is provided with a spongy-matrix body that is arranged proximate to an opening controlled by a valve element that can be operated from the outside of the container body, the valve element comprising a cap body that can be actuated rotationally in order to pass from a closed position to an open position of the opening and/or vice versa.

U.S. Pat. No. 7,114,871 to Thiebaut discloses a packaging and application device for a product, specifically a cosmetic product. The device includes a receptacle for cleaning the product having a longitudinal axis and a passageway. The receptacle also includes a porous or fibrous applicator element capable of communicating with the product in the receptacle through the passageway. A dispensing element adapted for opening and closing the passageway. The device further contains a dispensing element adapted for opening and closing the passageway and includes a mobile part rotatable about the longitudinal axis between a first position in which the passage is closed and a second position in which the passage is open. The device also includes a closure cap capable of engaging a dispensing element.

In my prior U.S. Pat. No. 6,641,320, I disclosed an improvement to U.S. Pat. No. 4,685,820 to Kremer et al. comprising an applicator tip having a recess and a generally toroidal retaining ring disposed in the recess of the applicator tip. The recess cooperates with the retaining ring for preventing removal of the applicator tip from the liquid applicator device.

It is an object of the present invention is to improve upon U.S. Pat. No. 4,685,820 to Kremer et al. and U.S. Pat. No. 4,792,252 to Kremer et al. and my U.S. Pat. No. 6,641,320 to provide an improved liquid applicator for increasing the liquid capacity of the liquid applicator device.

Another object of the present invention is to provide an improved liquid applicator for a liquid applicator device for coupling the liquid applicator device to a container of increased volume.

Another object of the present invention is to provide an improved liquid applicator for a liquid applicator device for coupling the liquid applicator device to an enlarged container without altering the dispensing mechanism of the liquid applicator device.

Another object of the present invention is to provide an improved liquid applicator for a liquid applicator device that does not increase the cost of the dispensing mechanism of liquid applicator device.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects and a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a liquid applicator comprising a liquid container and a liquid dispensing mechanism, the device having a valve element movable disposed between an open position and a closed position for controlling the flow of the applicator liquid from the container, the liquid dispensing mechanism comprising a hollow cylindrical portion for supporting an applicator tip with an inner end of the applicator tip communicating with the valve element enabling an axial displacement of the applicator tip to move the valve element into the open position for enabling the applicator tip to apply the liquid to a surface. The improvement comprises an applicator closure having a closure coupling for coupling the applicator closure to a peripheral rim of a container.

In another embodiment of the invention, the improvement comprises the liquid container having a peripheral rim defining an opening the liquid container and an applicator closure having a closure coupling for coupling the applicator closure to a peripheral rim of a container.

In a more specific embodiment of the invention, the container includes a metallic container having a rolled peripheral rim. Alternatively, the container includes a polymeric container or a glass container having a molded peripheral rim.

In a one embodiment of the invention, the closure coupling includes an inner wall having a closure annular ring for securing the liquid dispensing mechanism. The closure coupling includes an outer wall and an intermediate resilient wall. The intermediate resilient wall resiliently retains the peripheral rim of a container between the outer wall and the intermediate resilient wall Preferably, the closure coupling includes an outer wall having an outer wall annular radially inward projection. An intermediate resilient wall cooperates with the outer wall for resiliently retaining the peripheral rim of a container between the outer wall annular radially inward projection and the intermediate resilient wall. The intermediate resilient wall is deformable for allowing the peripheral rim to pass over the outer wall annular radially inward projection and to engage with an underside surface of the peripheral rim upon insertion of the peripheral rim into the applicator closure.

In still another embodiment of the invention, the improvement comprises an applicator closure having a closure coupling for coupling the applicator closure to a peripheral rim of a container. A shield is secured to the liquid container for providing protection between the applicator tip and an operator grasping the liquid container. Preferably, the shield is removably secured to the liquid container.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 29 is an exploded view of the applicator closure of FIGS. 25-28 and a first portion of the liquid container;

FIG. 30 is an assembled view of the applicator closure and the first portion of the liquid container shown in FIG. 29;

Similar reference characters refer to similar parts throughout the several Figures of the drawings.

DETAILED DISCUSSION

Figures 1, 2:
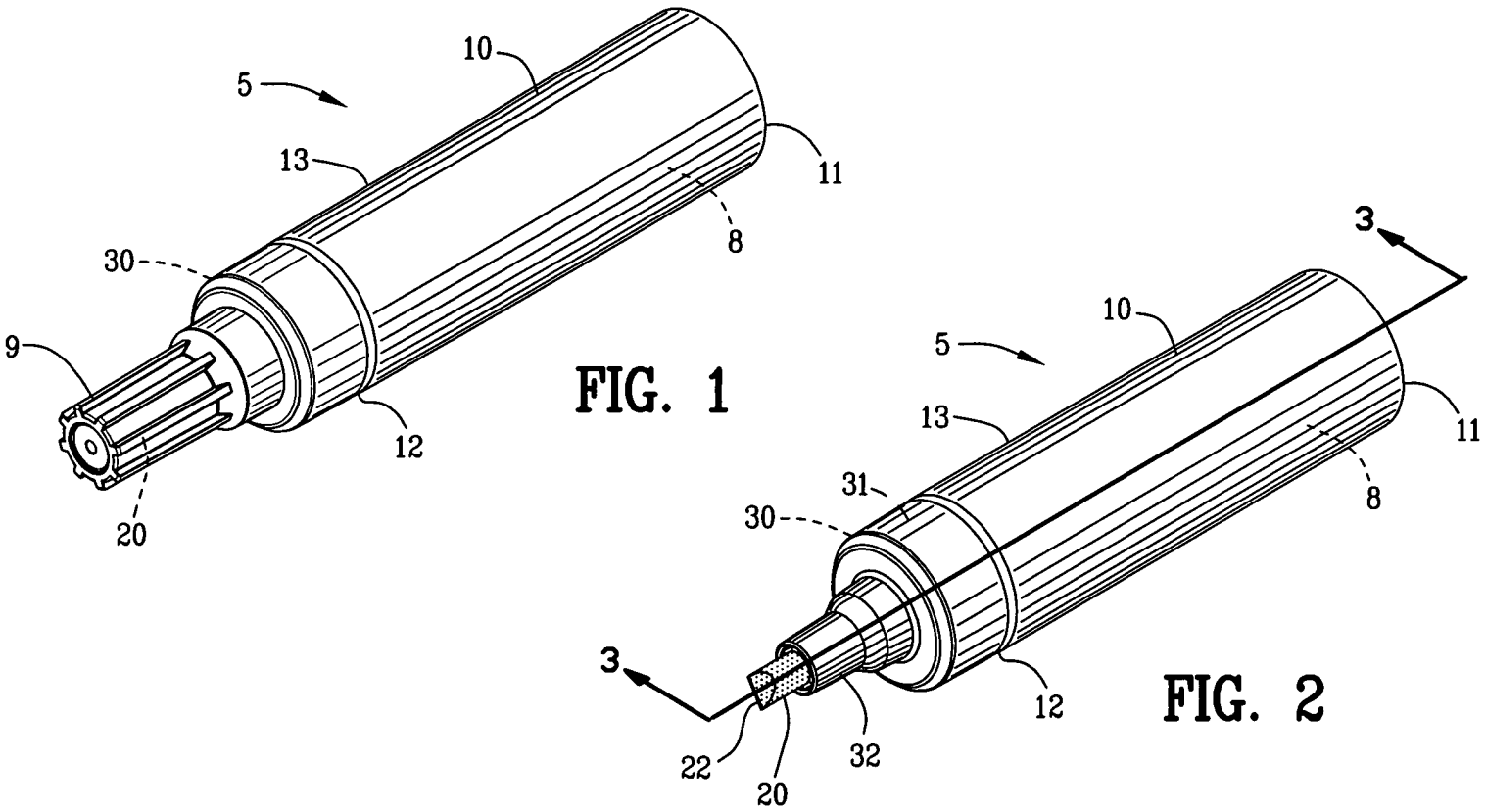
FIG. 1 is an isometric view of a liquid applicator device with a protective cap.
FIG. 2 is an isometric view of a liquid applicator device of FIG. 1 with the protective cap removed.

FIGS. 1 and 2 illustrate a liquid applicator device 5 for dispensing an applicator liquid 8 from a container 10. FIG. 1 illustrates the liquid applicator device 5 covered by a protective overcap 9 for preventing accidental dispensing of the applicator liquid 8. FIG. 2 illustrates the liquid applicator device 5 upon the removal of the protective overcap 9.

The liquid applicator device 5 comprises an applicator tip 20 for dispensing the applicator liquid 8 from the container 10 onto the surface (not shown) by a dispensing mechanism 30. As will be described in greater detail hereinafter, the applicator tip 20 is used to dispense the applicator liquid 8 from the container 10 onto the surface (not shown) upon the depression of the applicator tip 20 by the applicator surface.

Figure 3:
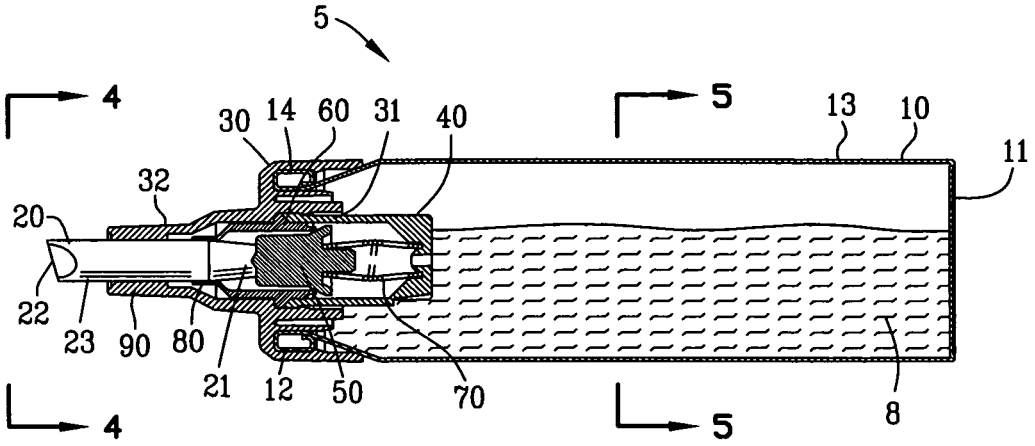
FIG. 3 is a sectional view along line 3-3 in FIG. 2.
Figure 4:
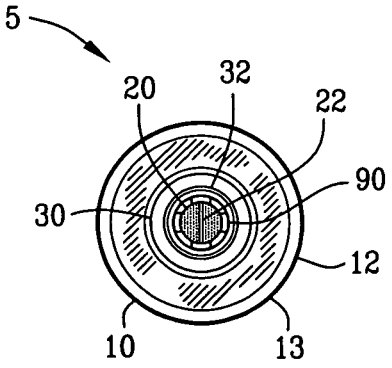
FIG. 4 is a sectional view along line 4-4 in FIG. 3.
Figure 5:
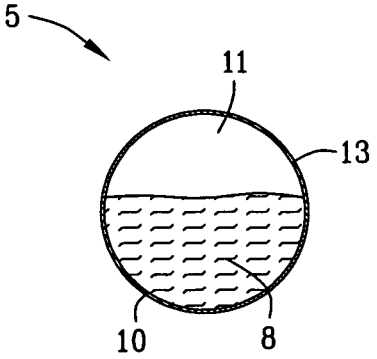
FIG. 5 is a sectional view along line 5-5 in FIG. 3.

FIGS. 3-5 are various views of the liquid applicator device 5 of FIG. 1. The container 10 has a closed end 11, an open end 12 and a generally cylindrical sidewall 13. The open end 12 is adapted to introduce a quantity of the applicator liquid 8 into the container 10. A peripheral rim 14 is located at the open end 12 to define the open end of the container 10. In this example, the container 10 is shown as an aluminum monobloc aerosol. The container 10 is commonly referred to as a curl lip aerosol container 10 with the curl lip describing the peripheral rim 14. However, it should be understood that virtually any type of a metallic, polymeric or glass container having a peripheral rim 14 maybe used with the present invention.

The applicator liquid 8 may be a marking liquid, a lubricating liquid, a cleaning liquid or any other type of liquid suitable for being dispensed by the applicator tip 20.

The applicator tip 20 extends between an inner end 21 and an outer end 22. The applicator tip 20 is a generally cylindrically shaped member defining a cylindrical diameter 23 between the inner end 21 and the outer end 22. The applicator tip 20 may formed from a felt fiber, solid or a brush construction. The applicator tip 20 may be rigid or flexible.

In this example of the invention, the applicator tip 20 is formed of a highly compacted fibrous material such as polyester or other similar material having analogous properties sufficient to hold the original shape when moistened with the applicator liquid 8 but adequate to pass the applicator liquid 8 from the inner end 21 to the outer end of the applicator tip 20 by capillary action. In the alternative, the applicator tip 20 may be a non-porous material with grooves extending longitudinally along an outer surface of the applicator tip 20.

The dispensing mechanism 30 includes an inner subassembly 31 and an outer subassembly 32. The inner subassembly 31 includes a valve body 40, a valve element 50, a valve seal 60, a spring 70 and a tubular seal 80. The inner subassembly 31 is identical to the inner subassembly set forth in U.S. Pat. No. 4,685,820 to Kremer et al. and U.S. Pat. No. 4,792,252 to Kremer et al. U.S. Pat. No. 4,685,820 to Kremer et al. and U.S. Pat. No. 4,792,252 to Kremer et al. are incorporated by reference into the present specification as if fully set forth herein.

The outer assembly 32 includes the improved applicator closure 90 of the present invention. The applicator closure 90 enables the inner subassembly 31 of U.S. Pat. No. 4,685,820 to be coupled to a container 10 having a peripheral rim 14. The use of a container 10 having a peripheral rim 14 provides an increased volume of the applicator liquid 8 than heretofore possible. The improved applicator closure 90 provides a support portion for positioning and slidably supporting the applicator tip 20.

Figure 6:
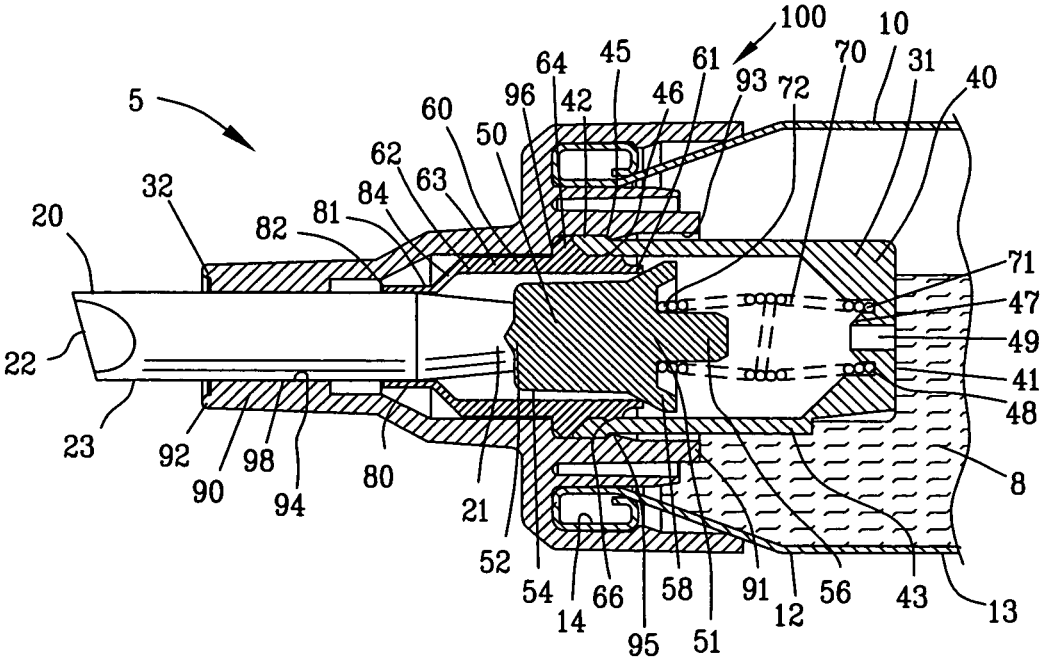
FIG. 6 is an enlarged view of a portion of FIG. 3 illustrating a liquid dispensing mechanism in a closed position.

FIG. 6 is an enlarged sectional view of the liquid dispensing mechanism 30 in a closed position. The valve body 40 extends between a valve body inner end 41 and a valve body outer end 42. The valve body inner end 41 comprises a face having vents whereas the valve body outer end 42 comprises an opening. A cylindrical sidewall 43 extends between the valve body inner end 41 and the valve body outer end 42.

A valve body shoulder 45 is formed on the valve body inner end 41 of the valve body 40. The valve body shoulder 45 is used for affixing the valve body 40 to the applicator closure 90. A valve body hollow 46 is defined within an inside surface of the cylindrical sidewall 43. The valve body hollow 46 is used for affixing the valve body 40 to the valve seal 60.

A valve body projection 47 extends from the valve body inner end 41 of the valve body 40. A circular recess 48 is defined within the valve body inner end 41 of the valve body 40 and encircles the valve body projection 47. The valve body projection 47 and the circular recess 48 cooperate to receive a first end 71 of the spring 70.

The valve body 40 is provided with a hole 49 defined within the valve body inner end 41 of the valve body 40. The hole 49 defined within the valve body 40 facilitates the flow of the applicator liquid 8 from the container 10 into the valve body 40.

The valve element 50 extends between a valve element inner end 51 and a valve element outer end 52. The valve element 50 defines a circumferential sidewall 54. A valve element projection 56 extends from the valve element inner end 51 of the valve element 50. The valve element projection 56 receives a second end 72 of the spring 70.

The circumferential sidewall 54 of the valve body 40 supports a flared peripheral shoulder 58. The outside diameter of the flared peripheral shoulder 58 is less than the inner diameter of the valve body 40 for enabling the valve element 50 to move within the valve body 40.

The valve seal 60 includes a valve seal inner end 61 and a valve seal outer end 62 with a cylindrical sidewall 63 extending therebetween. The cylindrical sidewall 63 is provided with a valve seal shoulder 64. The valve seal shoulder 64 is shown as a circumferential shoulder having a diameter greater than the remainder of the cylindrical sidewall 63 of the valve seal 60. The valve seal shoulder 64 has a diameter substantially the same diameter as the diameter of the valve body 40.

The valve seal 60 includes a valve seal annular bulge 66 extending about an outer surface of the cylindrical sidewall 63. The valve seal annular bulge 66 cooperates with the valve body hollow 46 of the valve body 40 for affixing the valve body 40 to the valve seal 60.

The valve seal 60 is press fit into the valve body 40 with the valve element 50 and the spring 70 located therebetween. The valve seal shoulder 64 limits the depth of penetration of the valve seal 60 into the valve body 40. The valve body hollow 46 of the valve body 40 receives the valve seal annular bulge 66 of the valve seal 60 for interlocking the valve seal 60 within the valve body 40 to form the inner subassembly 31 of the dispenser mechanism 30.

The outside diameter of the flared peripheral shoulder 58 of the valve element 50 is less than the inner diameter of the valve body 40 enabling the valve element 50 to move within the valve body 40. The outside diameter of the flared peripheral shoulder 58 of the valve element 50 is greater than the inner diameter of the valve seal inner end 61 of the valve seal 60 for enabling valve element 50 to form a seal with the valve seal 60.

The spring 70 biases the dispensing mechanism 30 in a closed condition as shown in FIG. 5. When the dispensing mechanism 30 in the closed condition, the flared peripheral shoulder 58 of the valve element 50 is biased by the spring 70 into engagement with the valve seal inner end 61 of the valve seal 60. The engagement of the flared peripheral shoulder 58 with the valve seal inner end 61 prevents the passage of the applicator liquid 8 from the container 10 to the tip 20.

A tubular seal 80 extends between a tubular seal inner end 81 and a tubular seal outer end 82. A mounting 84 integrally secures the tubular seal 80 to the valve seal outer end 62 of the valve seal 60. The tubular seal 80 provides a sliding seal with the applicator tip 20.

The inner end 21 of the applicator tip 20 is in direct engagement with the valve seal outer end 52 of the valve seal 50. The cylindrical diameter 23 of the applicator tip 20 forms a sliding seal with the tubular seal 80.

The applicator closure 90 extends between a closure inner end 91 and a closure outer end 92. The closure inner end 91 of the closure is open for receiving a portion of the inner subassembly 31 within an internal tapered region 93 of the applicator closure 90. The internal tapered region 93 communicates with a passageway 94 extending to the closure outer end 92 of the applicator closure 90.

The applicator closure 90 includes a closure annular ring 95 extending inwardly from the applicator closure 90. The internal tapered region 93 of the applicator closure 90 includes a closure shoulder 96 for cooperating with the valve seal shoulder 64 of the valve seal 60.

The internal tapered region 93 of the applicator closure 90 receives a portion of the inner subassembly 31 with the valve seal shoulder 64 engaging the closure shoulder 96. The closure annular ring 95 of the applicator closure 90 engages with the valve body shoulder 45 of the valve body 40 for interlocking the valve body 40 to the applicator closure 90 thereby joining the inner subassembly 31 to the outer subassembly 32.

The applicator closure 90 has support centering ribs 98 extending from the inner surface of the passageway 94. The support centering ribs 98 frictionally engages and supports the applicator tip 20. The support centering ribs 98 support the applicator tip 20 in a sliding engagement for enabling axial movement of the applicator tip 20 relative to the applicator closure 90. The inner end 21 of the applicator tip 20 engages the outer end 52 of the valve seal 50 whereas the outer end 22 of the applicator tip 20 extends from the applicator closure 90.

A closure coupling 100 joins the applicator closure 90 to the peripheral rim 14 for coupling the dispensing mechanism 30 to the container 10. The closure coupling 100 couples the dispensing mechanism 30 to the container 10 will be explained hereafter with reference to FIGS. 11-18.

Figure 7:
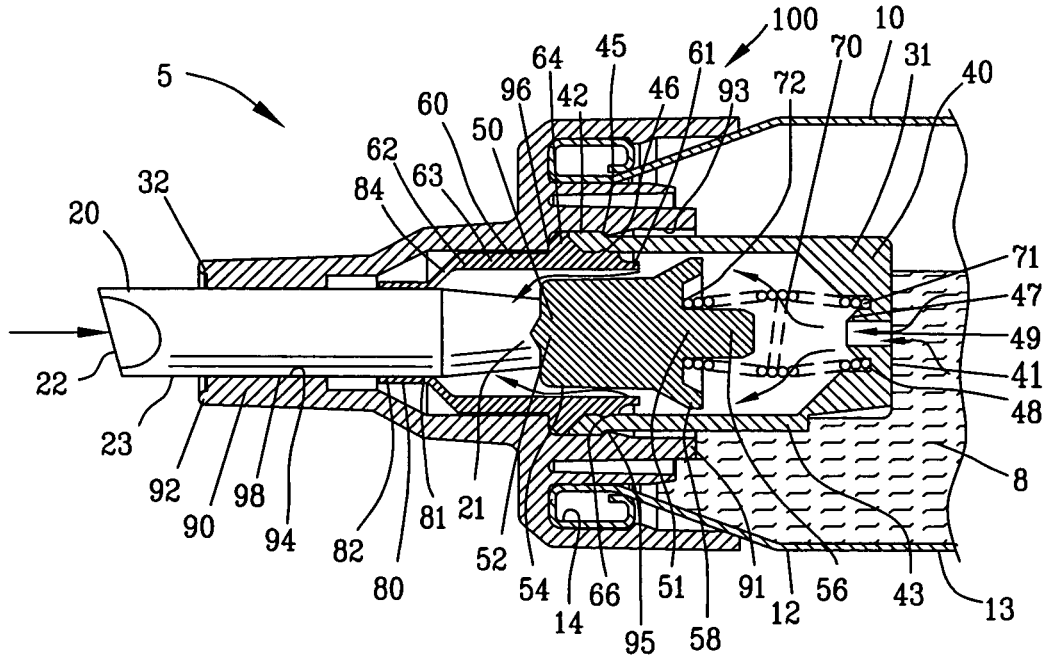
FIG. 7 is a view similar to FIG. 6 illustrating the liquid dispensing mechanism in an open position.

FIG. 7 is an enlarged sectional view similar to FIG. 6 illustrating the liquid dispensing mechanism 30 in an open position. The inner end 21 of the applicator tip 20 is in direct engagement with the valve seal outer end 52 of the valve seal 50. The cylindrical diameter 23 of the applicator tip 20 forms a sliding seal with the tubular seal 80. The cylindrical diameter 23 of the applicator tip 20 is supported in a sliding engagement by the support centering ribs 98 extending from the applicator closure 90 for enabling axial movement of the applicator tip 20 relative to the applicator closure 90.

A depression of the applicator tip 20 as indicated by the arrow against a surface (not shown) will compress the spring 70 and move the valve element 50 inwardly from the valve seal 60 to move the dispensing mechanism 30 in the open condition. The flared peripheral shoulder 58 of the valve element 50 is separated from the valve seal inner end 61 of the valve seal 60 for enabling the passage of the applicator liquid 8 from the container 10 into contact with the inner end 21 of the applicator tip 20. The applicator liquid 8 moves from the inner end 21 to replenish the applicator liquid 8 to the outer end 22 of the applicator tip 20 by capillary action and/or by action of gravity. The applicator liquid 8 at the outer end 22 of the applicator tip 20 may be transferred to a surface (not shown) by marking, dabbing or a brushing action.

Figure 8:
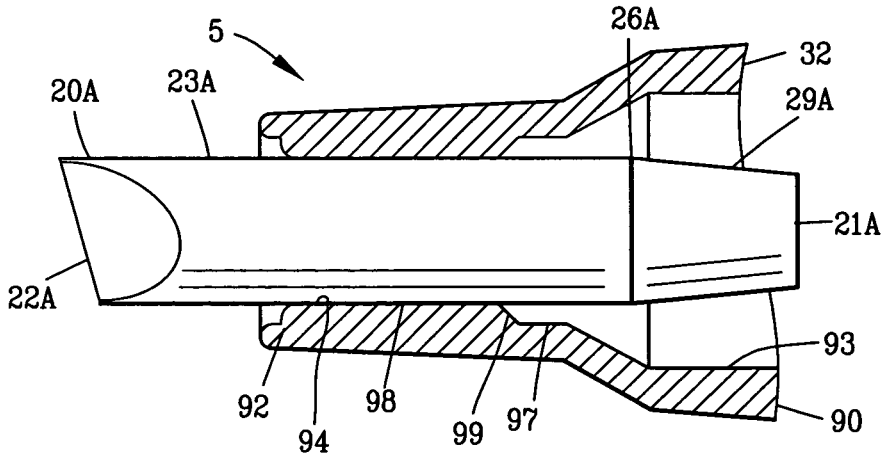
FIG. 8 is a magnified view of a first example of an applicator tip suitable for use liquid dispensing mechanism of FIGS. 6 and 7.

FIG. 8 is a magnified view of the first example of the applicator tip 20 shown in FIGS. 1-7. The applicator tip 20 is maintained within the applicator closure 90 by a frictional engagement as set forth in U.S. Pat. No. 4,685,820.

Figure 9:
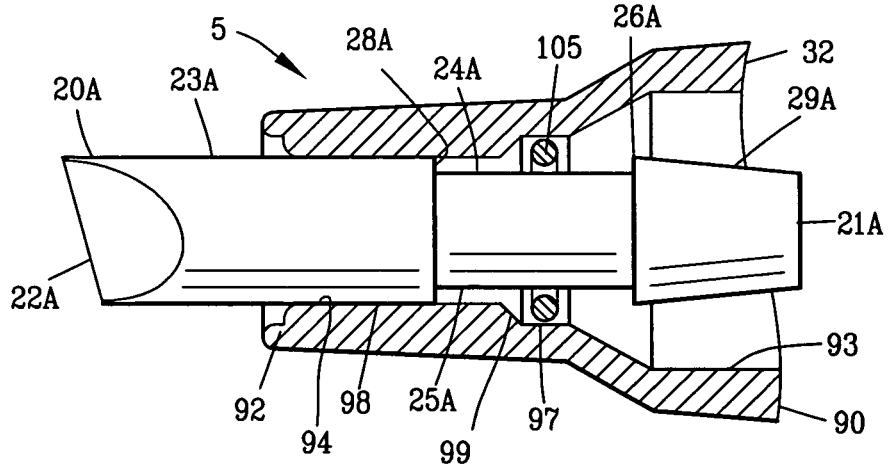
FIG. 9 is a magnified view of a second example of an applicator tip suitable for use liquid dispensing mechanism of FIGS. 6 and 7.
Figure 12:
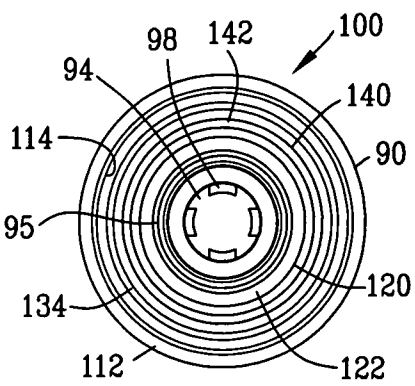
FIG. 12 is a rear view of the applicator closure of FIG. 10.
Figure 10:
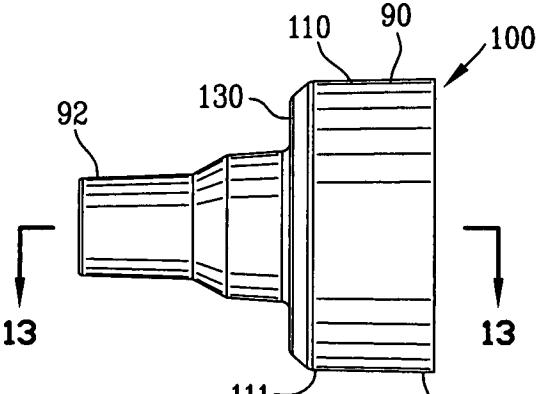
FIG. 10 is an enlarged view of the applicator closure of the present invention.
Figure 11:
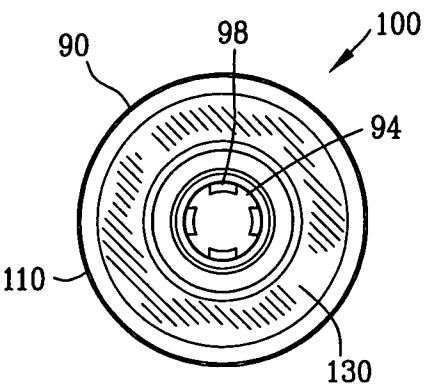
FIG. 11 is a front view of the applicator closure of FIG. 10.
Figure 14:
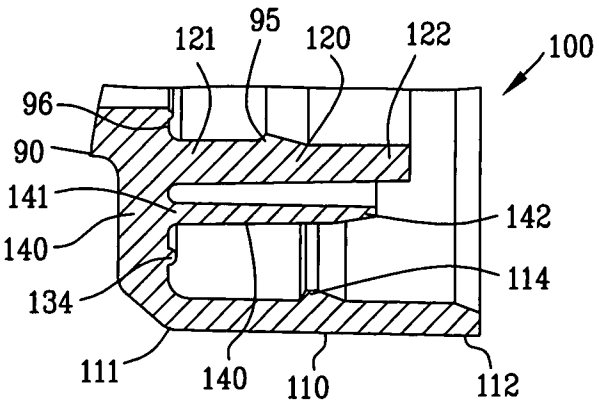
FIG. 14 is a magnified view a portion of the applicator closure of FIG. 13.
Figure 13:
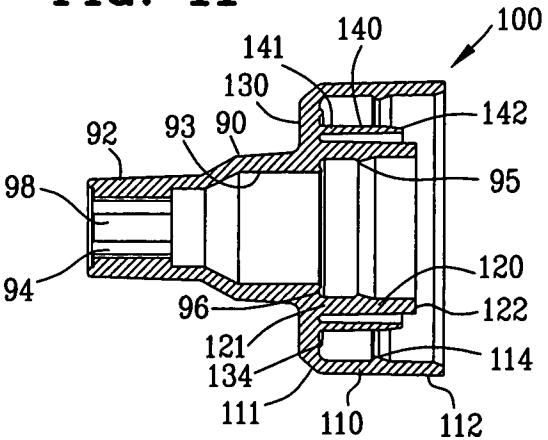
FIG. 13 is a view along line 13-13 in FIG. 10.

FIG. 9 is a magnified view of a second example of an applicator tip 20A suitable for use liquid dispensing mechanism of FIGS. 6 and 7. In this example, the applicator tip 20A is maintained within the applicator closure 90 by a retaining ring 105 is located within the annular recess 24A as set forth in my U.S. Pat. No. 6,641,320. U.S. Pat. No. 6,641,320, to Ballot et al. is incorporated by reference into the present specification as if fully set forth herein.

FIGS. 10-14 illustrate the applicator closure 90 and the closure coupling 100 for coupling the applicator closure 90 to the container 10. The closure coupling 100 comprises an outer wall 110, an inner wall 120 a transverse wall 130 and a resilient intermediate wall 140. The outer wall 110 extends between a proximal end 111 and a distal end 112. Similarly, the inner wall 120 extends between a proximal end 121 and a distal and 122. The transverse wall 130 extends between the outer wall 110 and the inner wall 120. The resilient intermediate wall 140 extends between a proximal end 141 and a distal end 142. The proximal end 141 of the resilient intermediate wall 140 is secured to the transverse wall 130.

The resilient intermediate wall 140 is located between the outer wall 110 and the inner wall 120. The proximal ends 111, 121 and 141 of the outer wall 110, the inner wall 120 and the resilient intermediate wall 140 are integrally formed with the transverse wall 130 as a one-piece unit. The distal ends 112, 122 and 142 of the outer wall 110, the inner wall 120 and the resilient intermediate wall 140 extend from the transverse wall 130 in a generally parallel relationship.

The inner wall 120 carries the closure annular ring 95 for securing the inner subassembly 31 to the applicator closure 90. The outer wall 110 includes an outer wall annular radially inward projection 114 for engaging with the peripheral rim 14 of the container 10. The transverse wall 130 supports an annular axially extending projection seal 134 for sealing the applicator closure 90 to the container 10. The resiliency of the resilient intermediate wall 140 allows the distal and 142 to bend along the length of the resilient intermediate wall 140.

The outer wall 110 cooperates with the resilient intermediate wall 140 and the projection seal 134 for sealing the applicator closure 90 to the container 10. The interrelationship of the outer wall 110 cooperating with the resilient intermediate wall 140 and the projection seal 134 for sealing the applicator closure 90 to the container 10 will be explained in greater detail with reference to FIGS. 15-18.

Figure 16:
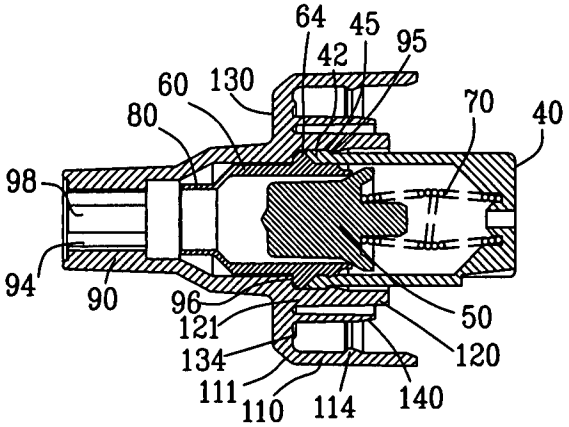
FIG. 16 is an assembled view of the applicator closure and the liquid dispensing mechanism of FIG. 15.
Figure 15:
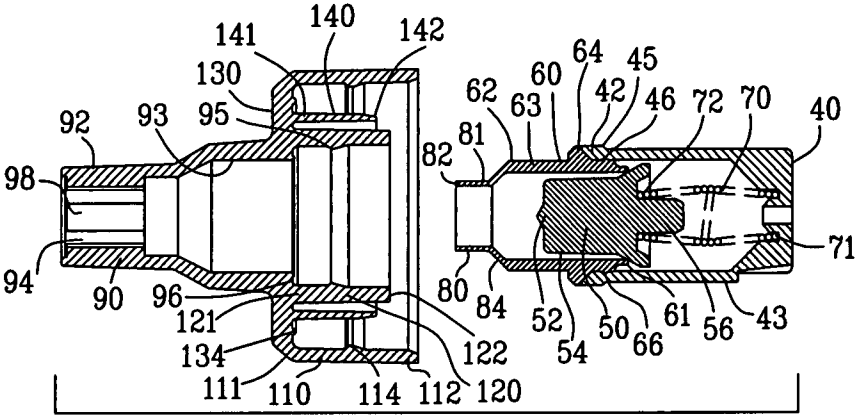
FIG. 15 is an exploded view of the applicator closure and the liquid dispensing mechanism.

FIGS. 15 and 16 are exploded and assembled views of the applicator closure 90 and the inner subassembly 31. The annular ring 95 on the inner wall 120 of the applicator closure 90 receives the annular bulge of the valve seal 60 for securing the inner subassembly 31 to the applicator closure 90.

Figure 18:
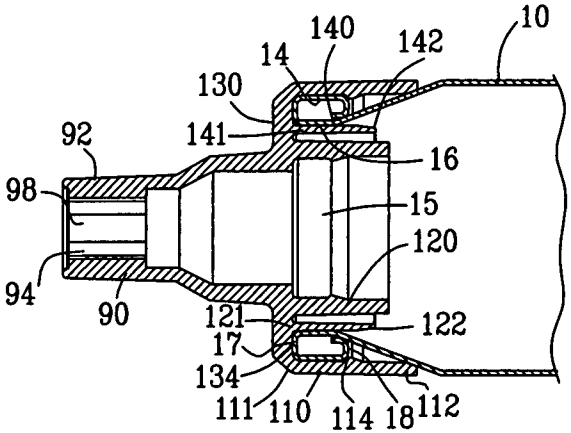
FIG. 18 is an assembled view of the applicator closure and the liquid container of FIG. 17.
Figure 17:
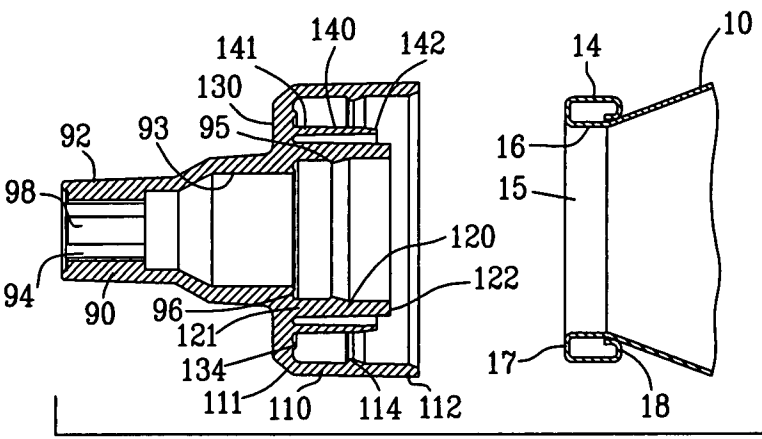
FIG. 17 is an exploded view of the applicator closure and a liquid container.

FIGS. 17 and 18 are exploded and assembled views of the applicator closure 90 and a liquid container 10. The peripheral rim 14 of the container 10 defines an opening 15 in the liquid container 10 by an inner surface 16. The peripheral rim 14 further comprises an end surface 17 defining a peak of the peripheral rim 14. An underside surface 18 is defined by the termination of the peripheral rim 14 and the sidewall of the liquid container 10.

When the peripheral rim 14 of the container 10 is inserted within the closure coupling 100 of the applicator closure 90, the resilient intermediate wall 140 is deformed for allowing insertion of the peripheral rim 14. The resilient intermediate wall 140 enables the peripheral rim 14 to pass over the outer wall annular radially inward projection 114 during insertion of the peripheral rim 14.

After insert of the peripheral rim 14, the outer wall annular radially inward projection 114 engages with the underside surface 18 of the peripheral rim 14. The resilient intermediate wall 140 maintains contact pressure to the inner surface 16 of the peripheral rim 14 to keep the outer wall annular radially inward projection 114 in engagement with the underside surface 18 of the peripheral rim 14. The end surface 17 of the peripheral rim 14 engages with the annular axially extending projection seal 134 of the transverse wall 130 for sealing the applicator closure 90 to the container 10.

Figure 19:
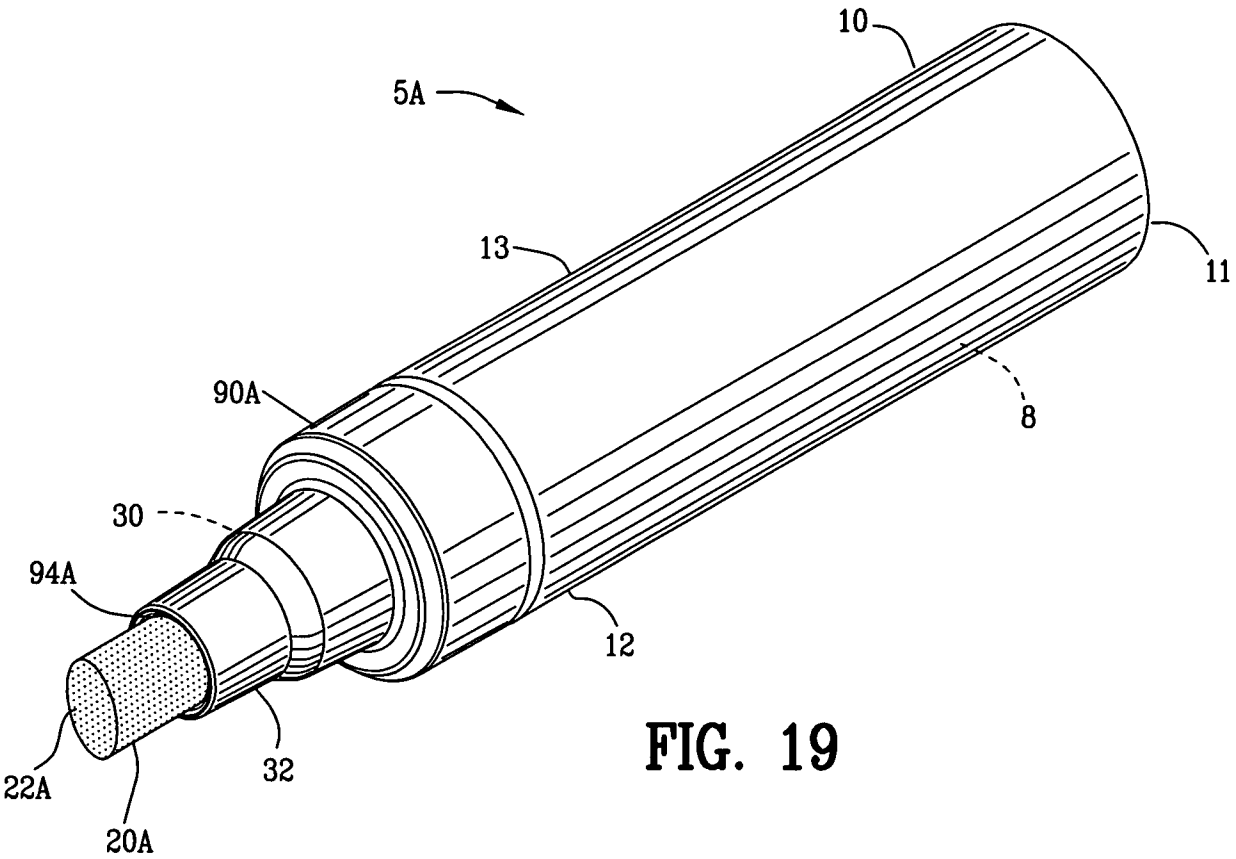
FIG. 19 is an isometric view of a second embodiment of liquid applicator device with the protective cap removed.
Figure 20:
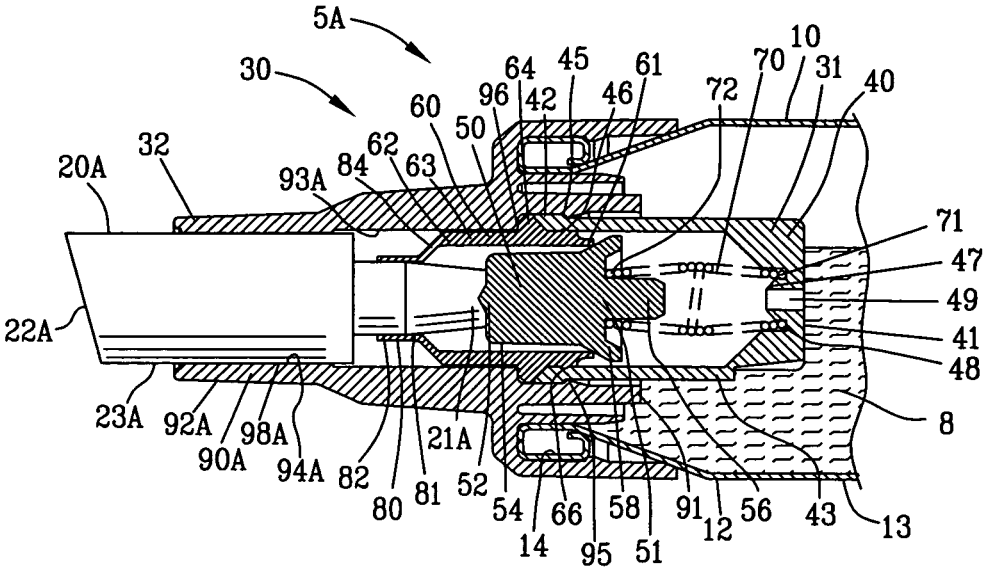
FIG. 20 is an enlarged section view of a portion of FIG. 19 illustrating the liquid dispensing mechanism in a closed position.
Figure 21:
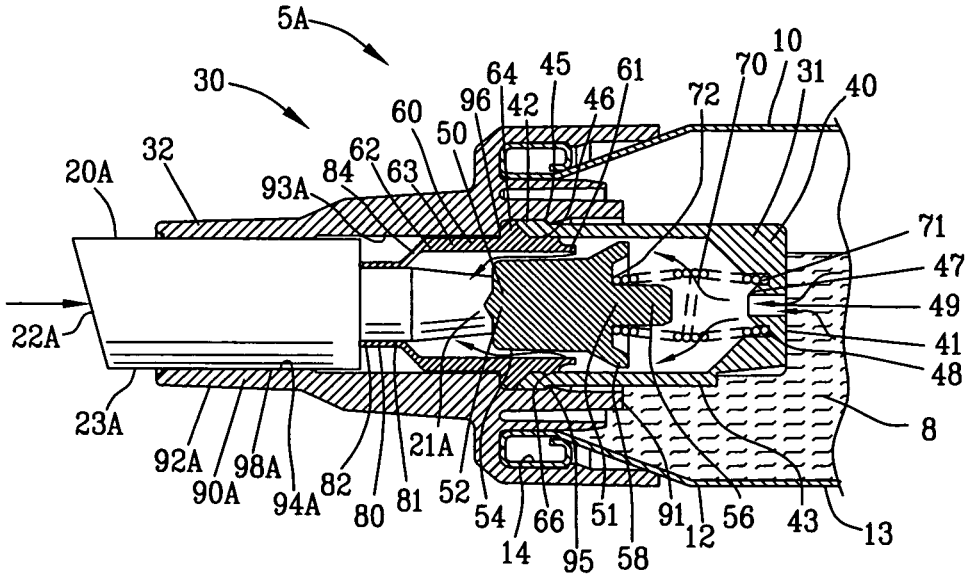
FIG. 21 is a view similar to FIG. 20 illustrating the liquid dispensing mechanism in an open position.

FIGS. 19-21 are various views of a second embodiment of liquid applicator device 5A of the present invention. Similar parts are labeled with similar reference characters as FIGS. 1-19. In the embodiment, the liquid applicator device 5A is provided with an applicator closure 90A having an enlarged passageway 94A for receiving an enlarged tip 20A. The enlarged tip 20A comprises a generally cylindrical inner end 21A and an enlarged generally cylindrical outer end 22A. The generally cylindrical inner end 21A is slidably received within the tubular seal 80 in a manner similar to FIGS. 1-18. The enlarged outer end 22A is shown with an enlarged distal circular end for applying the liquid 8 to a large surface area.

Figure 22:
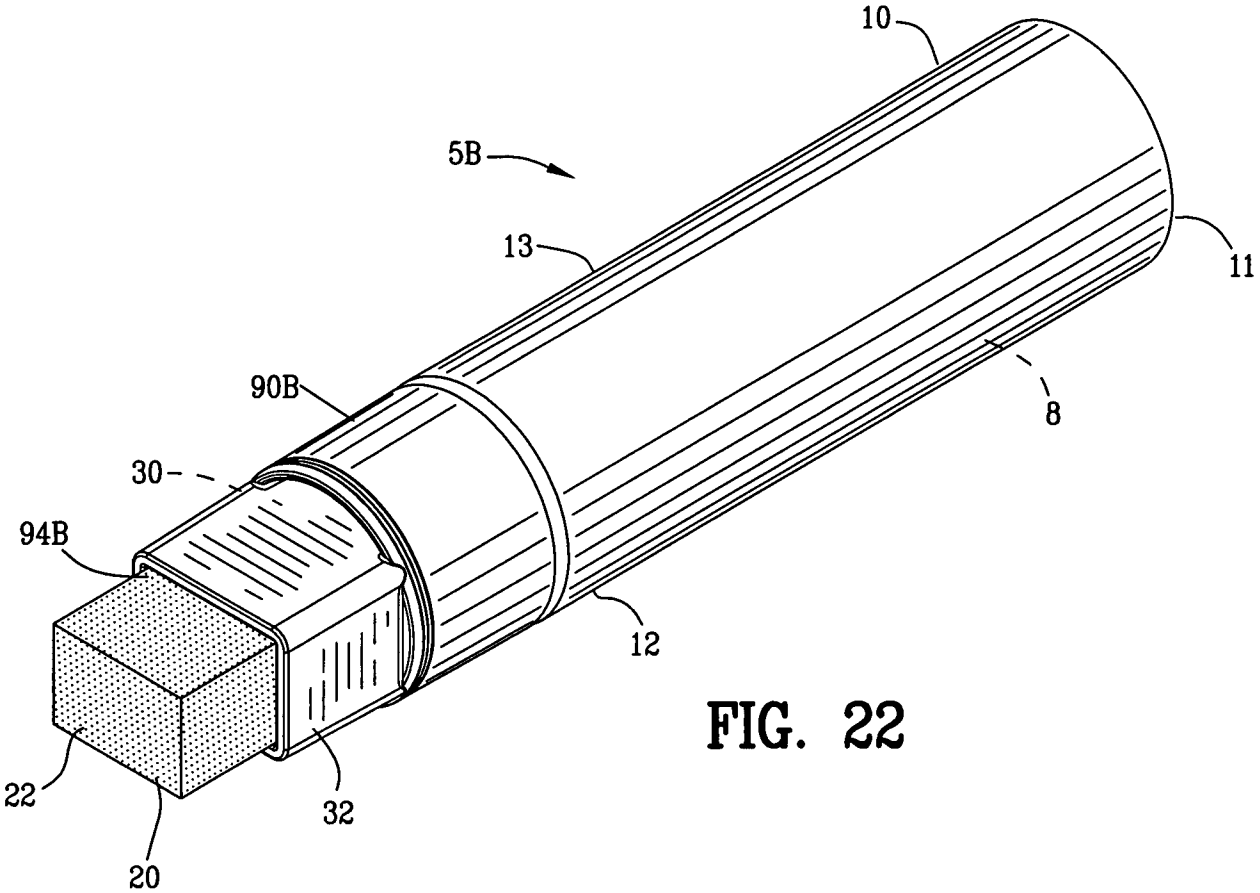
FIG. 22 is an isometric view of a third embodiment of liquid applicator device with the protective cap removed.
Figure 23:
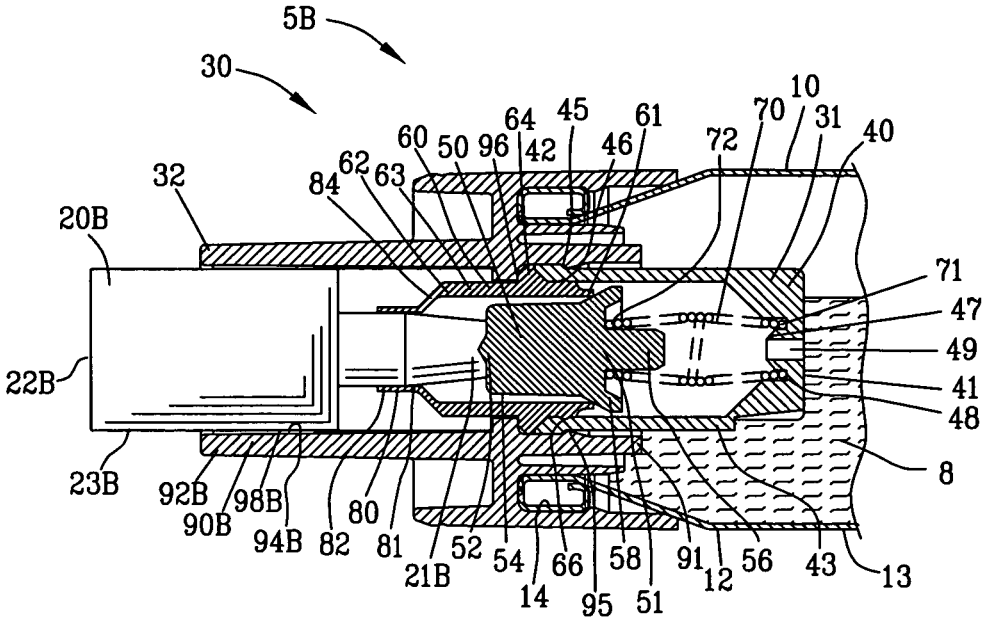
FIG. 23 is an enlarged sectional view of a portion of FIG. 22 illustrating the liquid dispensing mechanism in a closed position.
Figure 24:
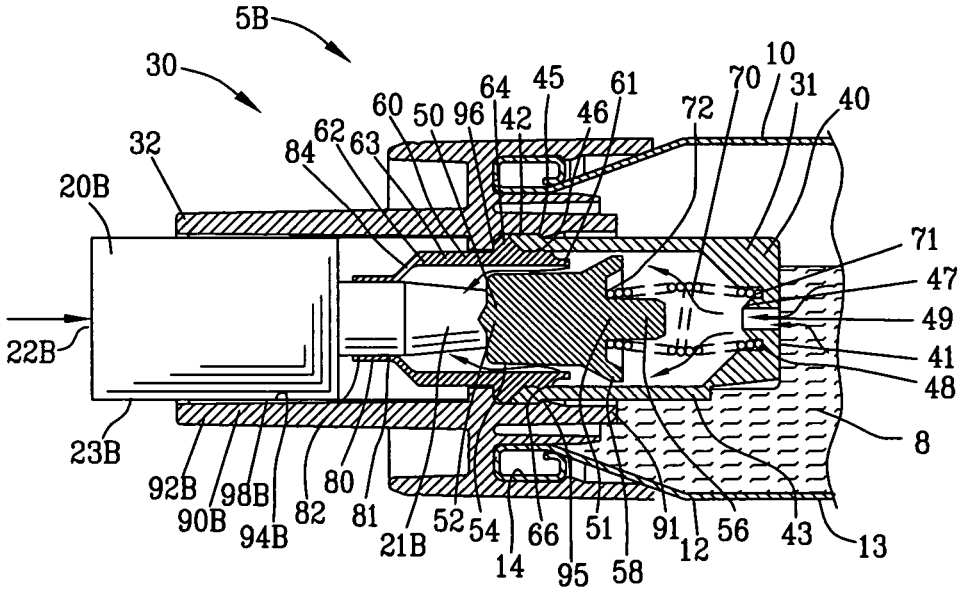
FIG. 24 is a view similar to FIG. 23 illustrating the liquid dispensing mechanism in an open position.

FIGS. 22-24 are various views of a third embodiment of liquid applicator device 5B of the present invention. Similar parts are labeled with similar reference characters as FIG. 19-21. In the embodiment, the liquid applicator device 5B is provided with an applicator closure 90B having an enlarged passageway 94B for receiving an enlarged tip 20B. The enlarged tip 20B comprises a generally cylindrical inner end 21B and an enlarged outer end 22B having a rectangular cross-section. The generally cylindrical inner end 21B is slidably received within the tubular seal 80 in a manner similar to FIGS. 19-21. The enlarged outer end 22A is shown with an enlarged rectangular distal end for applying the liquid 8 to a large surface area.

FIGS. 25-35 are various views of a fourth embodiment of liquid applicator device 5C for dispensing an applicator liquid 8 from a container 10C. The liquid applicator device 5C comprises an applicator tip 20C for dispensing the applicator liquid 8 from the container 10C by a dispensing mechanism 30. The dispensing mechanism 30 is similar to the dispensing mechanism 30 shown in FIGS. 1-24.

In this example, the container 10C has an open end 11C, an open end 12C and a cylindrical sidewall 13C. Either of the open ends 11C and 12C may be used to introduce the applicator liquid 8 into the container 10C. The peripheral rim 14C is located at the open end 12C of the container 10C. An end plug 150C is used for sealing the open end 11C of the container 10C.

In this example, the container 10C including the peripheral rim 14C is molded as a one piece unit from a polymeric material. However, it should be understood that the virtually any type of a material such as glass, ceramic material may be used for forming the container 10C for the present invention.

The applicator tip 20C extends between an inner end 21C and an outer end 22C. The applicator tip 20C is shown as having a generally rectangular cross-section that extends uniformly between the inner end 21C and the outer end 22C.

The dispensing mechanism 30C includes an inner subassembly 31C and an outer subassembly 32C. The inner subassembly 31C includes a valve body 40C, a valve element 50C, a valve seal 60C and a spring 70C. In contrast to the dispensing mechanisms shown in FIGS. 1-24, dispensing mechanisms the 30C lacks a tubular seal 80.

The outer assembly 32C includes the applicator closure 90C for coupling the inner subassembly 31C to the peripheral rim 14C of the container 10C. The applicator closure 90C includes a smooth passageway 94 lacking the centering ribs 98 shown in FIGS. 15-18 for providing a seal between the applicator tip 20C and the applicator closure 90C. The inner end 21C of the applicator tip 20C is in direct engagement with the valve seal 50C. The applicator tip 20 forms a sliding seal with the smooth passageway 94 of the applicator closure 90C. A closure coupling 100C joins the applicator closure 90C to the peripheral rim 14C for coupling the dispensing mechanism 30 to the container 10C.

Figure 26:
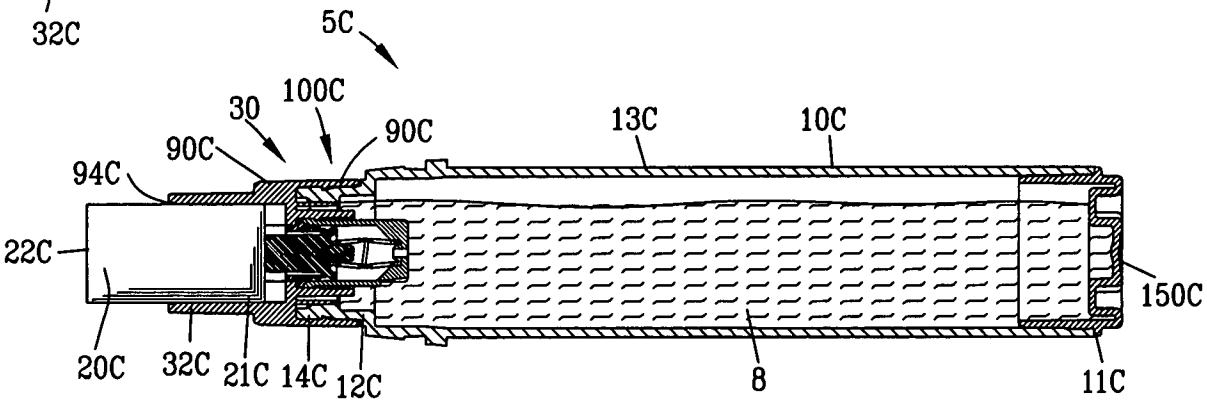
FIG. 26 is a sectional view along line 26-26 in FIG. 25.
Figure 27:
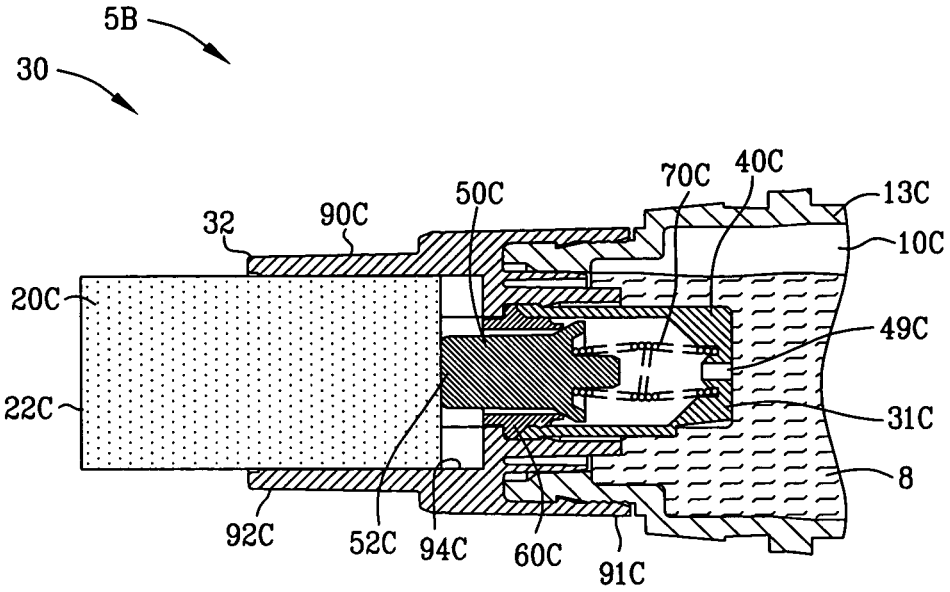
FIG. 27 is an enlarged view of a portion of FIG. 26 illustrating a liquid dispensing mechanism in a closed position.
Figure 28:
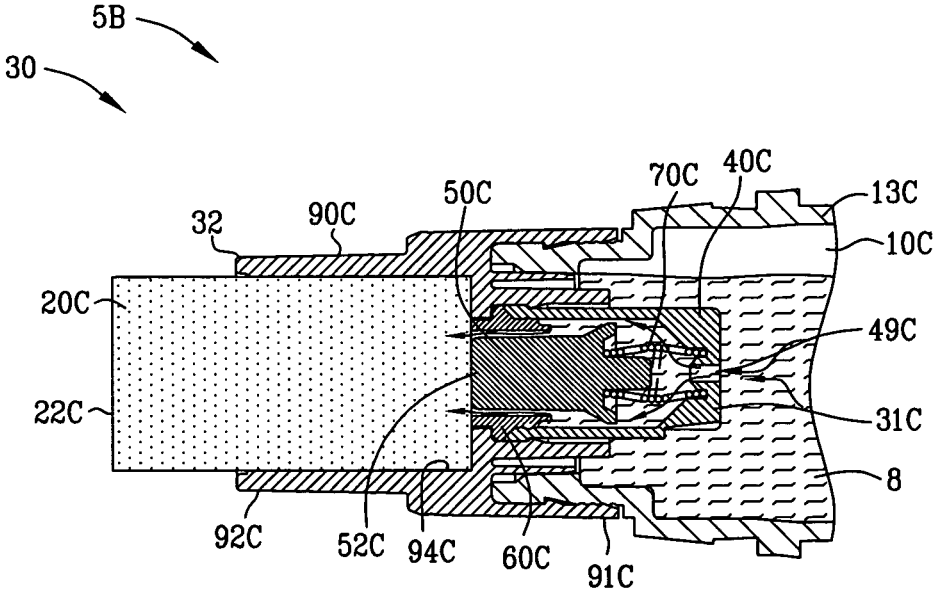
FIG. 28 is a view similar to FIG. 27 illustrating the liquid dispensing mechanism in an open position.

FIGS. 27 and 28 are enlarged views of a portion of FIG. 26 illustrating a liquid dispensing mechanism 30 in a closed position and an open position, respectively. The dispensing mechanism 30 operates in a manner as heretofore described.

FIG. 29 is an exploded view of the applicator closure 90C of FIGS. 25-28 and a first portion of the liquid container 10C. The closure coupling 100C is identical to the closure coupling 100 heretofore described with reference to FIGS. 11-14.

The peripheral rim 14C of the liquid container 10C is integrally molded with the liquid container 10C. The liquid container 10C includes a series of container connectors 160C including a plurality of circumferential projection 161C and a stop shoulder 162C. An annular taper 163C extends from the stop shoulder 162C to a container annular shoulder 164C. A mounting recess 165C is located intermediate the annular taper 163C and the container annular shoulder 164C.

FIG. 30 is an assembled view of the applicator closure 90C and the first portion of the liquid container 10C shown in FIG. 29. The peripheral rim 14C of the liquid container 10C is inserted within the closure coupling 100C of the applicator closure 90C. The resilient intermediate wall 140C is deformed for allowing insertion of the peripheral rim 14C. The peripheral rim 14C, the outer wall annular radially inward projection 114C engages with the underside surface 18C of the peripheral rim 14C when the first end 91C of the applicator closure 90C engages with the stop shoulder 162C. The resilient intermediate wall 140C maintains contact pressure to the inner surface 16C of the peripheral rim 14C to keep the outer wall annular radially inward projection 114C in engagement with the underside surface 18C of the peripheral rim 14C. The end surface 17C of the peripheral rim 14C engages with the annular axially extending projection seal 134C of the transverse wall 130C for sealing the applicator closure 90C to the container 10C. The plurality of circumferential projection 161C insure proper sealing of the liquid container 10C to the applicator closure 90C.

Figure 25:
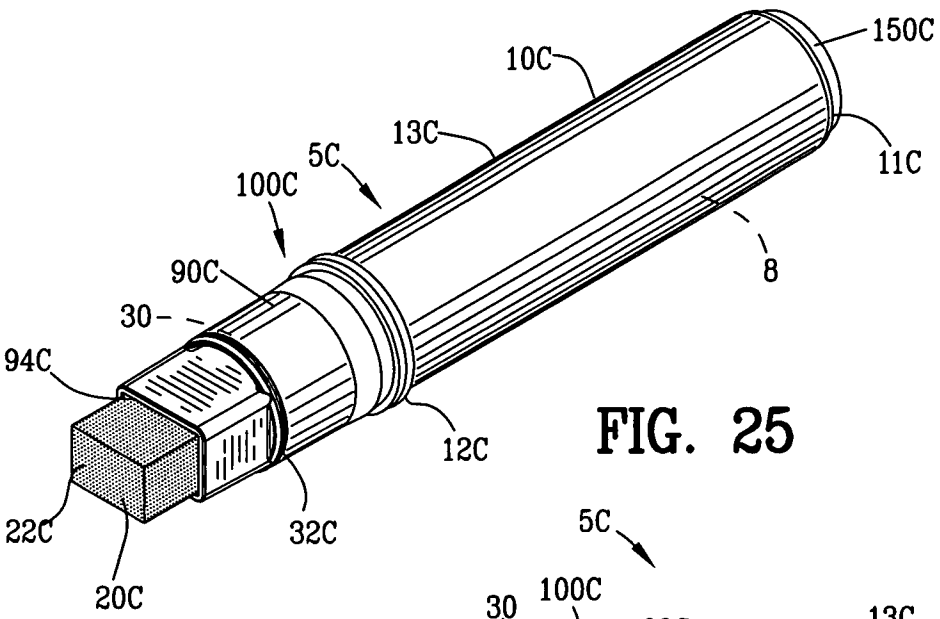
FIG. 25 is an isometric view of a fourth embodiment of a liquid applicator device.
Figure 31:
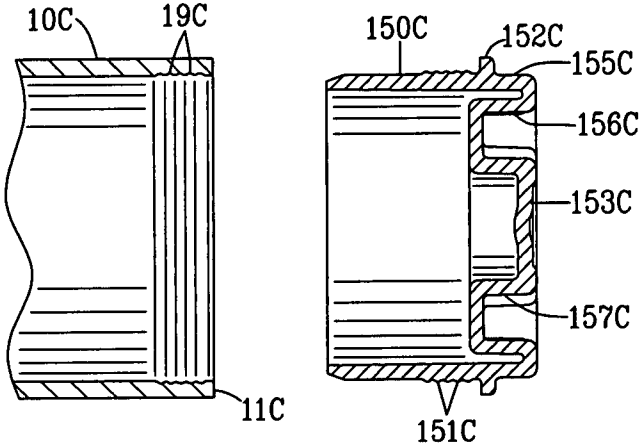
FIG. 31 is an exploded view of an end plug of FIGS. 25 and 26 and a second portion of the liquid container.

FIG. 31 is an exploded view of the end plug 150C of FIGS. 25 and 26 and a second portion of the liquid container 10C. The liquid container 10C includes a plurality of circumferential recesses 19C located on an interior surface of the liquid container 10C. The end plug 150C comprises a plurality of circumferential projection 151C located on an exterior surface of the end plug 150C. A stop shoulder 152C extends outwardly from the end plug 150C and is located adjacent to the plurality of circumferential projection 151C.

A central projection 153C is located in an end surface of the end plug 150C. The central projection 153C defines an outer mounting surface 155C and an intermediate mounting surface 156C as well as an inner mounting surface 157C. The function of the outer mounting surface 155C, the intermediate mounting surface 156C and the inner mounting surface 157 will be described with reference to FIGS. 33-35.

Figure 32:
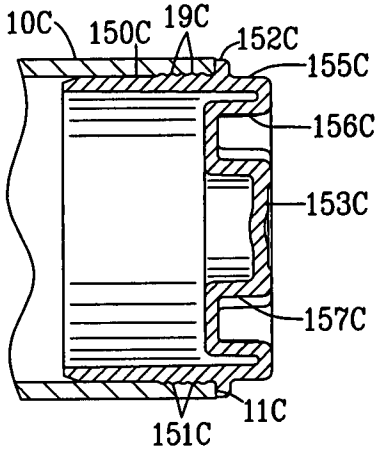
FIG. 32 is an assembled view of the end plug and the second portion of the liquid container of FIG. 31.

FIG. 32 is an assembled view of the end plug 150C and the second portion of the liquid container 10C of FIG. 31. The end plug 150C is shown inserted within the end 11C of the container 10C with the plurality of circumferential projection 151C located on the exterior surface of the end plug 150C engaging with the plurality of circumferential recesses 19C located on an interior surface of the liquid container 10C. The end 11C of the container 10C is shown engaging with the stop shoulder 152C of the end plug 150C.

Figure 33:
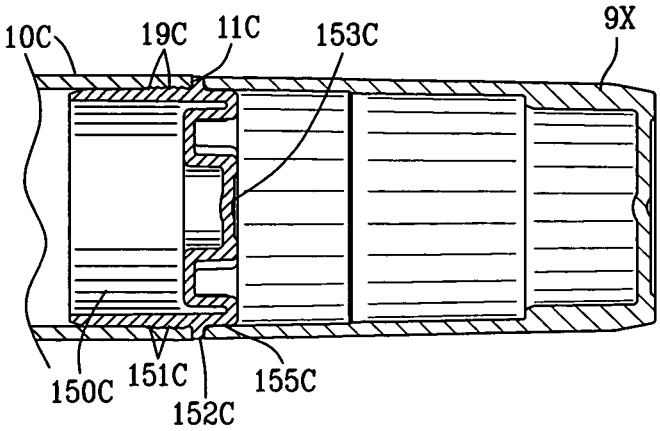
FIG. 33 is a side sectional view of the end plug removably retaining a large size protective cap.

FIG. 33 is a side sectional view of the end plug 150C removably retaining a large size protective cap 9X. The outer mounting surface 155C of the end plug 150C is dimensioned to removable receive and temporally store the large size protective cap 9X.

Figure 34:
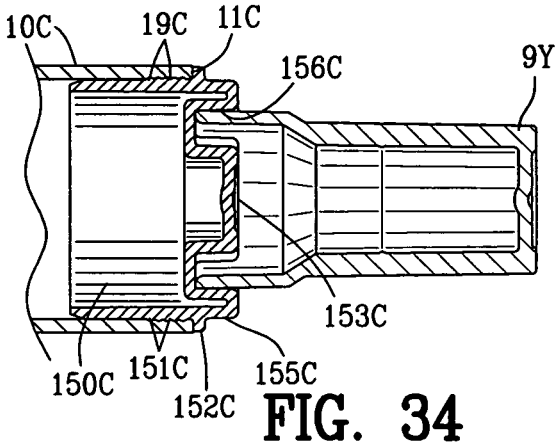
FIG. 34 is a side sectional view of the end plug removably retaining an intermediate size protective cap.

FIG. 34 is a side sectional view of the end plug 150C removably retaining an intermediate size protective cap 9Y. The intermediate mounting surface 156C of the end plug 150C is dimensioned to removable receive and temporally store the intermediate size protective cap 9Y.

Figure 35:
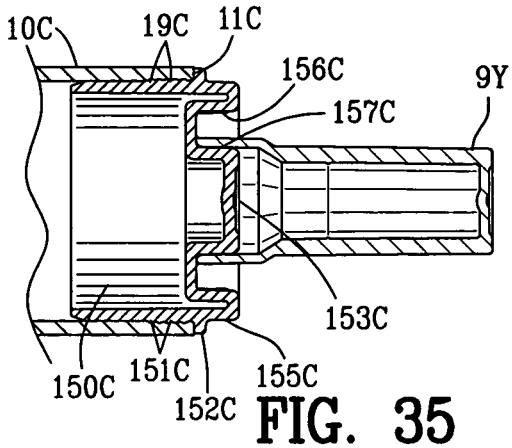
FIG. 35 is a side sectional view of the end plug removably retaining a small size protective cap.

FIG. 35 is a side sectional view of the end plug 150C removably retaining a small size protective cap 9Z. The inner mounting surface 157C of the end plug 150C is dimensioned to removable receive and temporally store the small size protective cap 9Z.

Figure 36:
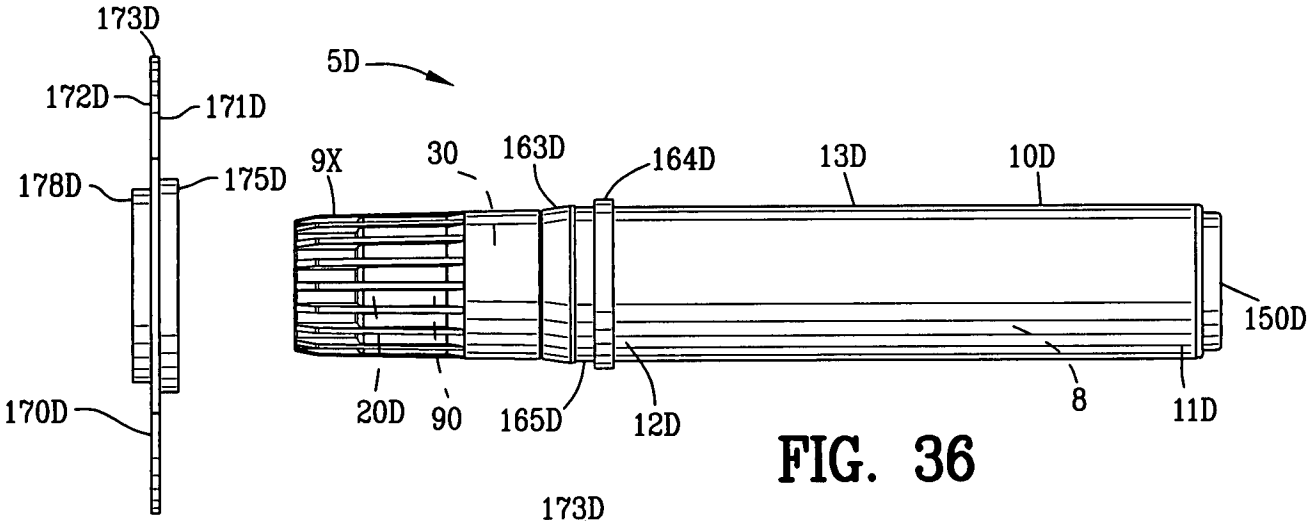
FIG. 36 is a side exploded view of a fifth embodiment of a liquid applicator device and a protective shield.
Figure 37:
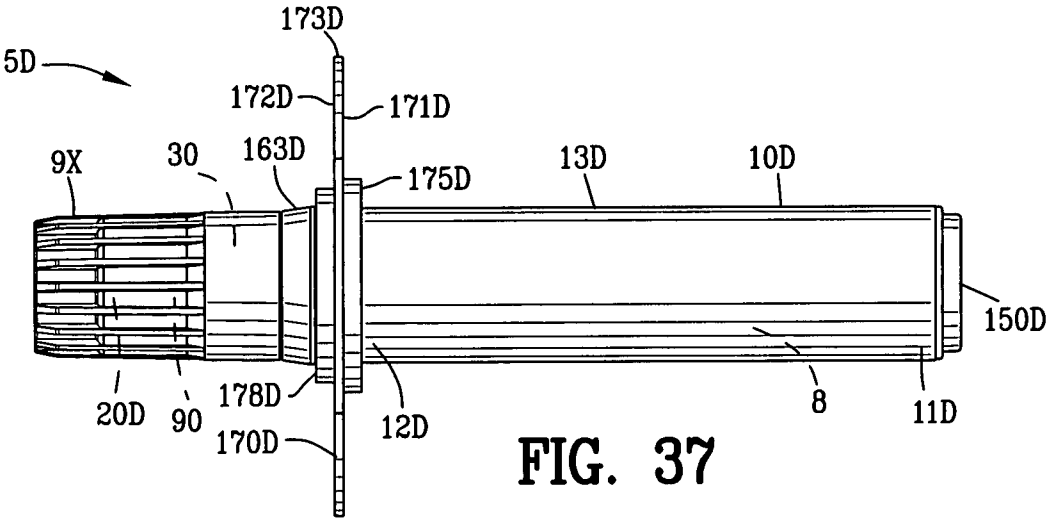
FIG. 37 is an assembled view of FIG. 36.

FIGS. 36 and 37 are side exploded and side assembled views of a fifth embodiment of a liquid applicator device 5D and a protective shield 170D. The liquid applicator device 5D similar to the fourth embodiment of a liquid applicator device 5C shown in FIGS. 25-35. The protective shield 170D is optional to the operation of the liquid applicator device 5D and may be removably secured to the applicator closure 90D of the liquid applicator device 5D.

Figure 39:
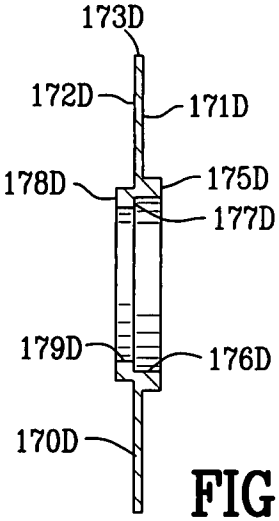
FIG. 39 is a side sectional view of the protective shield of FIGS. 36-37.
Figure 38:
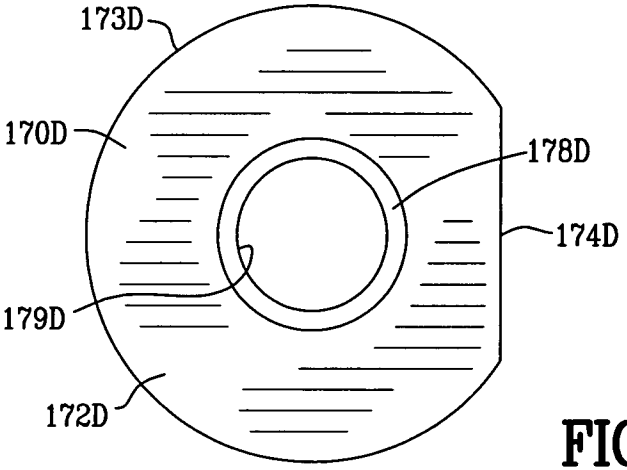
FIG. 38 is a front view of the protective shield of FIGS. 36-37.

FIGS. 38 and 39 are front view and side sectional views of the protective shield 170D of FIGS. 36-37. The protective shield 170D comprises an inner surface 171D and an outer surface 172D defined by an outer periphery 173D. In this example, the protective shield 170D is shown as generally circular having a flat 174D but it should be understood that the outer periphery 173D may take various shapes depending upon the intended use. In this example, the generally circular outer periphery 173D has the flat 174D for preventing rolling of the liquid applicator device 5D when placed upon a surface (not shown). The protective shield 170D is made from a deformable and resilient material.

The protective shield 170D includes an inner shoulder 175D having an inner diameter 176D. An outer shoulder 178D has a smaller outer diameter 176D. The inner diameter 176D communicates with the smaller outer diameter 176D through an internal step 177D.

Figure 41:
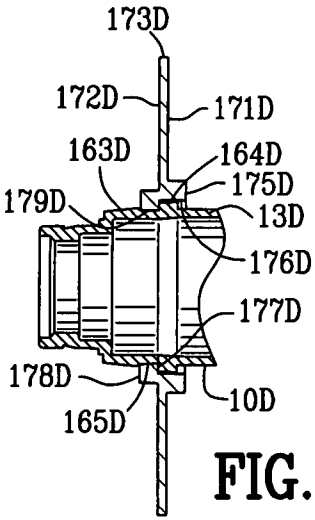
FIG. 41 is an assembled view of FIG. 40.
Figure 40:
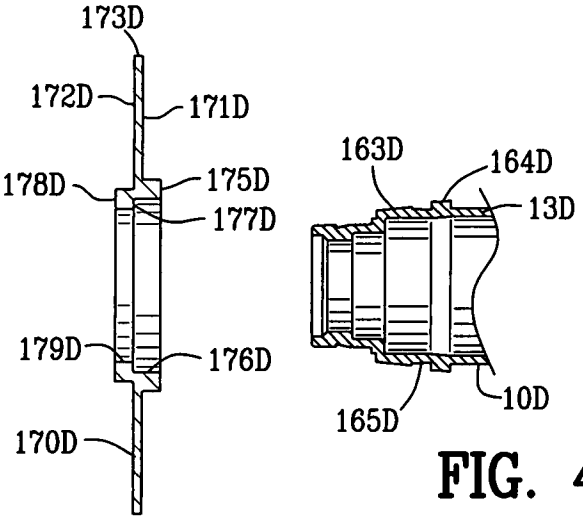
FIG. 40 is a side sectional exploded view of a protective shield and a portion of the liquid container of FIGS. 36-37.

FIGS. 40 and 41 are side sectional exploded and assembled views of the protective shield 170D and a portion of the liquid container 10D of FIGS. 36-37. The protective shield 170D is secured to the liquid container 10D of the liquid applicator device 5D by passing the inner diameter 176D and the outer diameter 176D over the annular taper 163D of the liquid container 10D. The protective shield 170D is deformed until the internal step 177D engages the container annular shoulder 164D of the liquid container 10D. The resiliency of the protective shield 170D causes the outer shoulder 178D to be received by the mounting recess 165D for removably securing the protective shield 170D to the liquid container 10D.

The present disclosure includes that contained in the appended claims as well as the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. .A liquid applicator comprising a liquid container having a peripheral rim and a liquid dispensing mechanism, the liquid dispensing mechanism having a valve element movably disposed between an open position and a closed position for controlling the flow of an applicator liquid from the liquid container, the liquid dispensing mechanism further comprising a valve body defining a hollow cylindrical portion for supporting an applicator tip with an inner end of the applicator tip communicating with the valve element disposed within the valve body enabling an axial displacement of the applicator tip to move the valve element into the open position for enabling, the applicator tip to apply the liquid to a surface, a valve body shoulder formed on an outer surface of the valve body of the liquid dispensing mechanism;

the improvement comprising:

an applicator closure having an inner wall having a closure annular ring extending from said inner wall of said applicator closure engaging with the valve body shoulder of said valve body for affixing the liquid dispensing mechanism to said applicator closure; and a closure coupling for coupling the applicator closure to the peripheral rim of the liquid container.

2. A liquid applicator as set forth in claim 1, wherein the liquid container is a metallic container; and the peripheral rim of the container comprising a rolled peripheral rim.

3. A liquid applicator as set forth in claim 1, wherein the liquid container is a polymeric container; and the peripheral rim of the container comprising a molded peripheral rim.

4. A liquid, applicator as set forth in claim 1, wherein the liquid container is a glass container, and the peripheral rim of the container comprising a formed peripheral rim,

5. A liquid applicator as s forth in claim 1, wherein said closure coupling includes an outer wall and an intermediate resilient wall; and said intermediate resilient wall resiliently retaining the peripheral rim of the liquid container between said outer wall and said intermediate resilient wall.

6. A liquid applicator as set forth in claim 1, wherein said closure coupling includes an outer wall having an outer wall annular radially inward projection; and an intermediate resilient wall cooperating with said outer wall for resiliently retaining the peripheral rim of the liquid container between said outer wall annular radially inward projection and said intermediate resilient wall.

7. A liquid applicator as set forth in claim 1, wherein said closure coupling includes an outer wall having an outer wall annular radially inward projection; and an intermediate resilient wall being deformable for allowing said peripheral rim of the liquid container to pass over said outer wall annular radially inward projection permitting said outer wall annular radially inward projection to engage with an underside surface of the peripheral rim of the liquid container upon insertion of said peripheral rim of the liquid container into said applicator closure for coupling the applicator closure to the liquid container.

8. A liquid applicator as set forth in claim 1, wherein said closure coupling comprises an outer wall extending between a proximal end and a distal end;

said inner wall extending between a proximal end and a distal end;

a transverse wall extending between said outer wall and said inner wall;

a resilient intermediate wall extending between a proximal end and a distal end;

said resilient intermediate wall being located between said outer wall and said inner wall;

said proximal ends of said outer will and said inner wall and said resilient intermediate wall being integrally formed with said transverse wall;

said distal ends of said outer wall and said inner wall and said resilient intermediate wall extending from said transverse wall in a generally parallel relationship;

said inner wall including said closure annular ring securing the said valve body of the liquid dispensing mechanism to the applicator closure; and said outer wall including said outer wall annular radially inward projection for engaging with the peripheral rim of the liquid container.

9. A liquid applicator as set forth in claim 1, wherein said applicator closure includes a transverse wall supporting an annular axially extending projection seal for sealing said applicator closure to the liquid container.

10. A liquid applicator for applying an applicator liquid from a liquid container onto a surface, the liquid container having a peripheral rim defining an opening in said liquid container;

an applicator closure having a hollow cylindrical portion;

a liquid dispensing mechanism having a valve element disposed within said applicator closure being movable between an open position and a closed position;

an applicator tip supported by said hollow cylindrical portion of said applicator closure with an inner end of the applicator tip communicating with the valve element;

a closure coupling extending from said applicator closure having an outer wall and an intermediate resilient wail;

said outer wall having an outer wall annular radially inward projection;

said intermediate resilient wall being deformable for allowing said peripheral rim to pass over said outer wall annular radially inward projection and to engage with an underside surface of said peripheral rim of the liquid container upon insertion of said peripheral rim into said applicator closure for coupling die applicator closure to the peripheral rim of the liquid container; and a depression of said applicator tip against the surface moving said valve element into said open position for enabling the flow of the applicator liquid from the liquid container to the applicator tip to enable said applicator tip to apply the liquid to the surface.

11. A liquid applicator as set forth in claim 10, wherein the peripheral rim of the liquid container is formed integrally with the liquid container.

12. A liquid applicator as set forth in claim 10, wherein the liquid container is a metallic container; and the peripheral rim of the metallic container comprising a rolled metallic rim.

13. A liquid applicator as set forth in claim 10, wherein the liquid container is a polymeric container; and the peripheral rim of the polymeric container comprising a molded peripheral rim formed with the polymeric container.

14. A liquid applicator as set forth in claim 10, wherein liquid container is a glass container; and the peripheral rim of the glass container comprising a molded peripheral rim formed with the glass container.

15. A liquid applicator comprising a liquid container having a peripheral rim and a liquid dispensing mechanism, the liquid dispensing mechanism having a valve element movably disposed between an open position and a closed position for controlling the flow of an applicator liquid from the liquid container, the liquid dispensing mechanism comprising a valve body defining a hollow cylindrical portion for supporting an applicator tip with an inner end of the applicator tip communicating with the valve element disposed within the valve body enabling an axial displacement of the applicator tip to move the valve element into the open position for enabling the applicator tip to apply the liquid to a surface, a valve body shoulder formed on an outer surface of the valve body of the liquid dispensing mechanism;

the improvement comprising:

an applicator closure having an inner wall having a closure annular ring extending from said inner wail of said applicator closure engaging with the valve body shoulder of said valve body for affixing the liquid dispensing mechanism to said applicator closure;

a closure coupling for coupling the applicator closure to the peripheral rim of the liquid container; and a shield secured to said applicator closure for providing protection between the applicator tip and an operator grasping the liquid container.

16. A liquid applicator as set forth in claim 15, wherein said shield is removably secured to said applicator closure.

17. A liquid applicator as set forth in claim 15, wherein said shield is removably secured within a mounting recess defined in said applicator closure.

18. A liquid applicator comprising a liquid container having a peripheral rim and a liquid dispensing mechanism, the liquid applicator having a valve element movably disposed between an open position and a closed position for controlling the flow of an applicator liquid from the liquid container, the liquid dispensing mechanism comprising a valve body defining a hollow cylindrical portion for supporting an applicator tip with an inner end of the applicator tip communicating with the valve element disposed within the valve body enabling an axial displacement of the applicator tip to move the valve element into the open position for enabling the applicator tip to apply the liquid to a surface, a valve body shoulder funned on an outer surface of the valve body: the improvement comprising:

an applicator closure having an inner wall, a resilient intermediate wall and an outer wall;

a closure annular ring extending from said inner wall of said applicator closure engaging with the valve body shoulder of said valve body for affixing the liquid dispensing mechanism to said applicator closure; and said intermediate resilient wall resiliently retaining the peripheral rim of the liquid container between said outer wall and said intermediate resilient wall for securing the liquid container to said applicator closure.

* * * * *